US009987846B2

(12) United States Patent
Shiota et al.

(10) Patent No.: US 9,987,846 B2
(45) Date of Patent: Jun. 5, 2018

(54) RECORDING APPARATUS

(71) Applicant: SEIKO EPSON CORPORATION, Tokyo (JP)

(72) Inventors: Takayuki Shiota, Fukuoka (JP); Hiroyuki Tajima, Fukuoka (JP); Akira Anami, Fukuoka (JP); Kazuhiko Tsuyama, Fukuoka (JP); Naoki Sakamoto, Fukuoka (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 14/729,370

(22) Filed: Jun. 3, 2015

(65) Prior Publication Data

US 2015/0375510 A1 Dec. 31, 2015

(30) Foreign Application Priority Data

Jun. 25, 2014 (JP) ..... 2014-130408

(51) Int. Cl.
*B41J 2/165* (2006.01)

(52) U.S. Cl.
CPC ..... *B41J 2/16508* (2013.01); *B41J 2/1652* (2013.01); *B41J 2/16523* (2013.01); *B41J 2/16532* (2013.01)

(58) Field of Classification Search
None
See application file for complete search history.

(56) References Cited

U.S. PATENT DOCUMENTS 6,270,183 B1 * 8/2001 Gaarder ..... B41J 2/1652 347/29
8,210,636 B2 * 7/2012 Uematsu ..... G03G 15/234 347/104
2008/0158288 A1 * 7/2008 Nagahara ..... B41J 2/16523 347/30

FOREIGN PATENT DOCUMENTS

JP 06-270408 A 9/1994
JP 2007-170275 A 7/2007

* cited by examiner

*Primary Examiner* — Alejandro Valencia

(57) ABSTRACT

A printer includes a cap unit, a transporting driving roller, a power transmitting unit, and a pump. At least a part of each of the cap unit, the transporting driving roller, the power transmitting unit, and the pump has the same height in a height direction of the apparatus (a Z-axis direction) and the cap unit, the transporting driving roller, the power transmitting unit, and the pump are arranged along a direction (a Y-axis direction) intersecting with a rotational axis line direction (an X-axis direction) of the transporting driving roller. Therefore, it is possible to arrange so as to suppress each dimension of the cap unit, the transporting driving roller, the power transmitting unit, and the pump in a height direction and it is possible to contribute to the miniaturization of the apparatus.

5 Claims, 19 Drawing Sheets

RECORDING APPARATUS

BACKGROUND

1. Technical Field

The present invention relates to a recording apparatus for performing recording on a medium.

2. Related Art

For a recording apparatus as an example of a liquid ejecting apparatus and furthermore, an ink jet printer as an example thereof, there is a recording apparatus including a maintenance mechanism for performing maintenance of a ink jet recording head (for example, refer to JP-A-2007-170275).

The maintenance mechanism is configured by including a cap for sealing a recording head and furthermore, sucking ink from a nozzle opening and a blade for wiping the recording head, furthermore, the cap is connected to a pump (for example, refer to JP-A-2007-170275).

Such a maintenance mechanism is provided so as to be able to displace a position at which maintenance of the recording head is performed and a position separated from the recording head. Furthermore, as a driving source for displacing the maintenance mechanism in this manner, there are some cases where a transporting roller for transporting a paper as an example of a medium is used. For example, there is a configuration of attaching a gear to a shaft end of the transporting roller and obtaining power from the gear.

There are many cases where the maintenance mechanism, the transporting roller, a power transmitting unit for transmitting power from the transporting roller to the maintenance mechanism, and the pump for generating negative pressure in the maintenance mechanism have to be collectively provided on the side face side of the apparatus due to a layout of the apparatus and thus, in particular, in a small printer which is required for the suppression of a height dimension, this easily becomes a barrier when suppressing the dimension of the apparatus.

SUMMARY

An advantage of some aspects of the invention is to provide a recording apparatus including a maintenance mechanism, a transporting roller, a power transmitting unit, and a pump, and taking further consideration of the suppression of each dimension in a height direction.

According to an aspect of the invention, there is provided a recording apparatus including: a recording head in which recording is performed by ejecting liquid with respect to a medium; a maintenance portion for performing maintenance of the recording head displaceably provided in a direction of being advanced and retracted with respect to the recording head; a pump which is connected to the maintenance portion by a tube; a transporting roller for transporting a medium; and a power transmitting unit for transmitting power from the transporting roller to the maintenance portion, in which at least a part of each of the maintenance portion, the transporting roller, the power transmitting unit, and the pump has the same height in a height direction of the apparatus and the maintenance portion, the transporting roller, the power transmitting unit, and the pump are arranged along a direction intersecting with a rotational axis line direction of the transporting driving roller.

According to the aspect, since at least a part of each of the maintenance portion, the transporting roller, the power transmitting unit, and the pump has the same height in a height direction of the apparatus and the maintenance portion, the transporting roller, the power transmitting unit, and the pump are arranged along a direction intersecting with a rotational axis line direction of the transporting roller, it is possible to arrange the maintenance portion, the transporting roller, the power transmitting unit, and the pump so as to suppress each dimension in a height direction and thus, it is possible to contribute to the miniaturization of the apparatus.

According to another aspect of the invention, there is provided a recording apparatus including: a recording head in which recording is performed by ejecting liquid with respect to a medium; a maintenance portion for performing maintenance of the recording head displaceably provided in a direction of being advanced and retracted with respect to the recording head; a pump which is connected to the maintenance portion by a tube; a transporting roller for transporting a medium; and a power transmitting unit for transmitting power from the transporting roller to the maintenance portion, in which at least a part of each of the maintenance portion, the power transmitting unit, and the pump has the same height in a height direction of the apparatus and the maintenance portion, the power transmitting unit, and the pump are arranged along a direction intersecting with a rotational axis line direction of the transporting roller.

According to the aspect, since at least a part of each of the maintenance portion, the power transmitting unit, and the pump has the same height in a height direction of the apparatus and the maintenance portion, the power transmitting unit, and the pump are arranged along a direction intersecting with a rotational axis line direction of the transporting roller, it is possible to arrange the maintenance portion, the power transmitting unit, and the pump so as to suppress each dimension in a height direction and thus, it is possible to contribute to the miniaturization of the apparatus.

The recording apparatus may further include a housing storing the maintenance portion, the transporting roller, the power transmitting unit, and the pump, in which at least more than one of the maintenance portion, the transporting roller, the power transmitting unit, and the pump are arranged along a bottom face of the housing.

According to the aspect, since at least more than one of the maintenance mechanism, the transporting roller, the power transmitting unit, and the pump are arranged along a bottom face of the housing, it is possible to arrange the maintenance portion, the transporting roller, the power transmitting unit, and the pump so as to further suppress each dimension in a height direction and thus, it is possible to further contribute to the miniaturization of the apparatus.

In the recording apparatus, at least more than one of the maintenance portion, the transporting roller, the power transmitting unit, and the pump may be arranged along a side wall of the housing.

According to the aspect, since at least more than one of the maintenance mechanism, the transporting roller, the power transmitting unit, and the pump are arranged along a wall side of the housing, it is possible to suppress the dimension of the apparatus in a rotational axis line direction of the transporting roller.

The recording apparatus may further include a carriage which includes the recording head and is movable in a predetermined direction; and a supporting member which is extended in a moving direction of the carriage and supports the carriage, in which the transporting roller is positioned on a lower side of the supporting member and is positioned in a region of the supporting member in a transporting direction of the medium.

According to the aspect, since the transporting roller is positioned at the lower side of the support member for supporting the carriage and is positioned in a region of the support member in a transporting direction of the medium, each dimension of the transporting roller and the support member is not independently added as to the dimension of the apparatus in a transporting direction of the medium and thus, it is possible to suppress the dimension of the apparatus in a transporting direction of the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described based on drawings. Meanwhile, as to the same configurations in each Example, the same signs are written, description will be given in only a first Example, and descriptions of the configurations will be omitted in other Examples.

Figure 1:
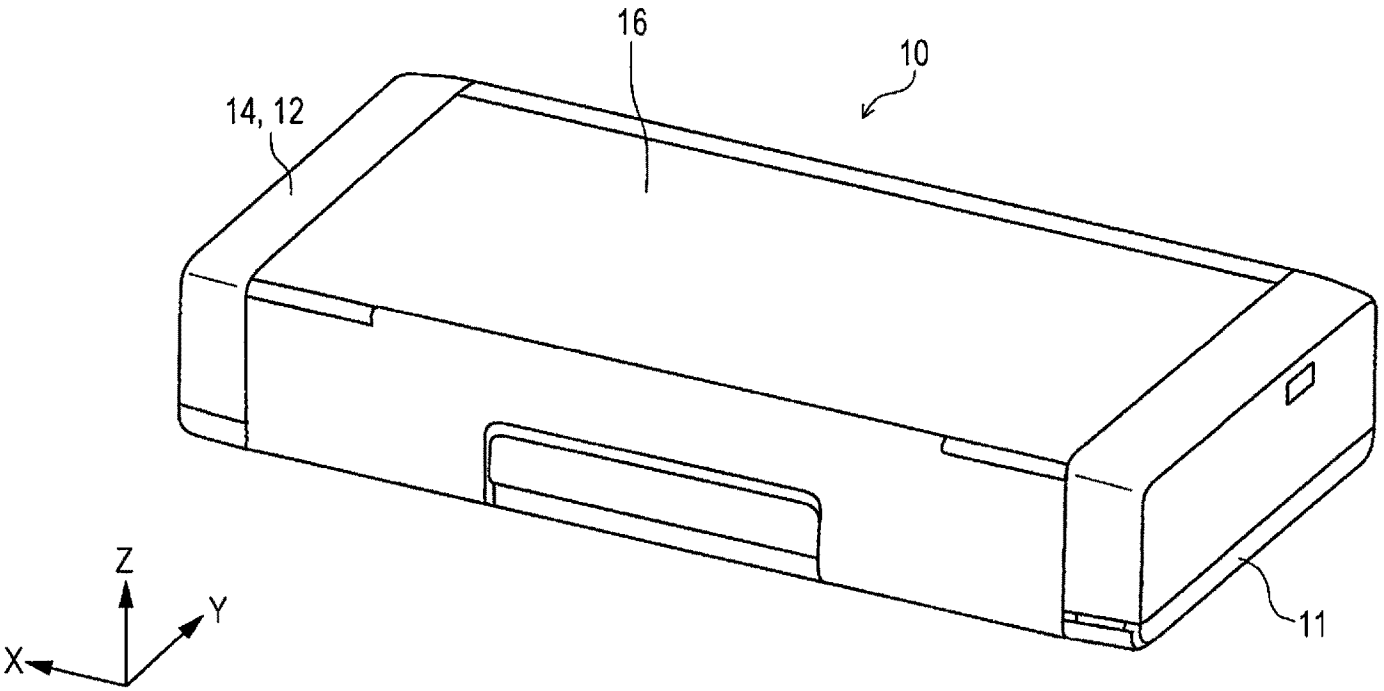
FIG. 1 is an appearance perspective view in a state in which a cover is closed in a printer according to the invention.
Figure 2:
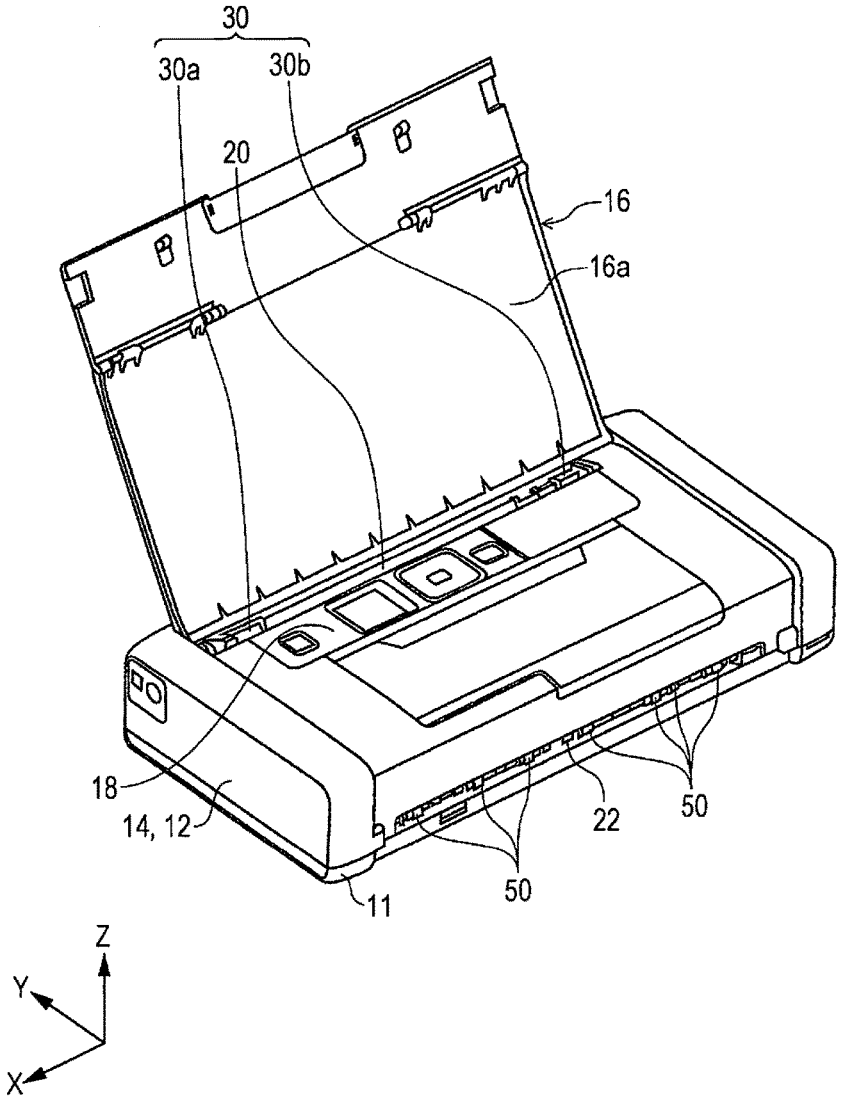
FIG. 2 is an appearance perspective view in a state in which the cover is opened in the printer according to the invention.
Figure 3:
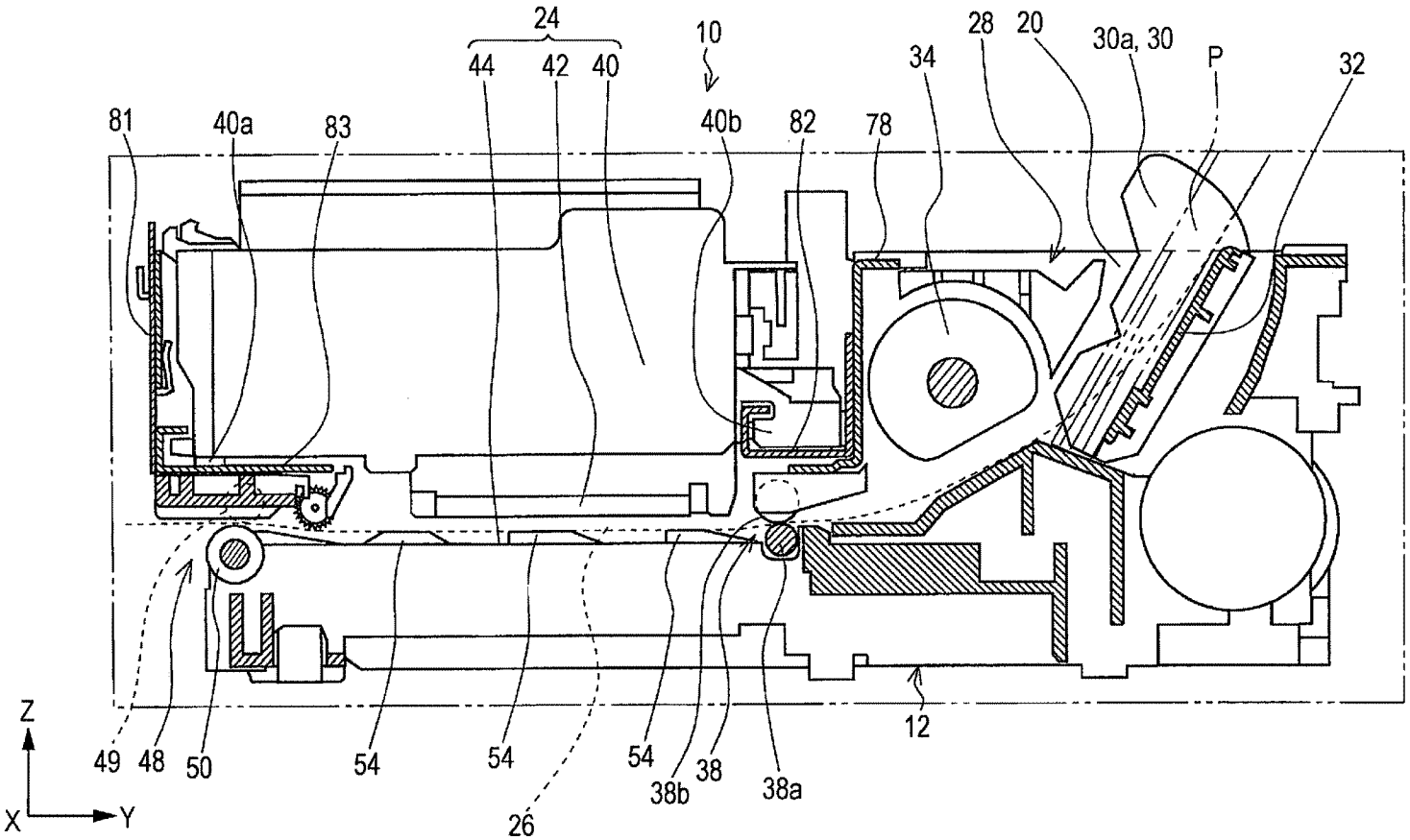
FIG. 3 is a side cross-sectional view illustrating a medium transporting route of the printer according to the invention.
Figure 4:
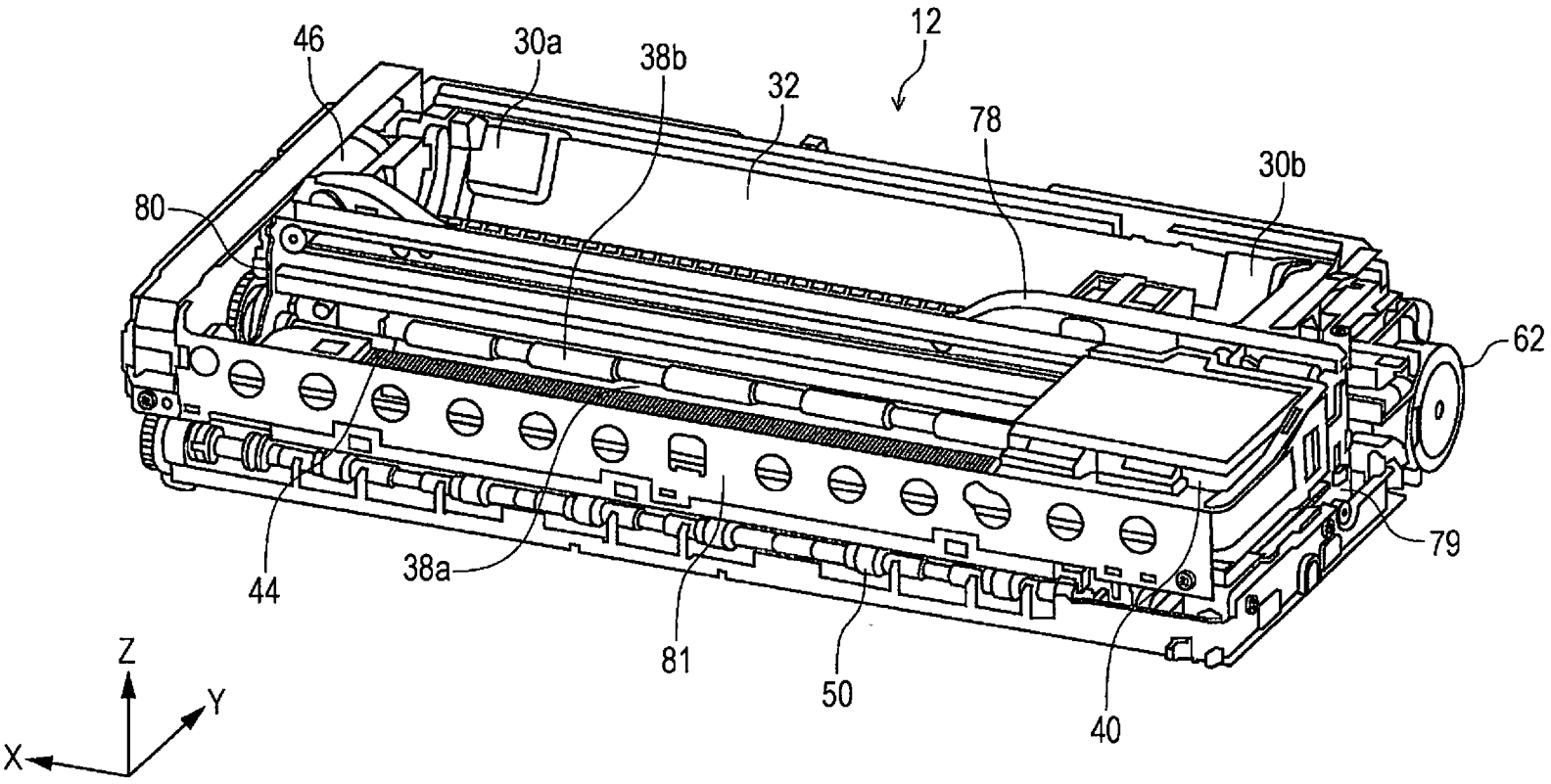
FIG. 4 is an appearance perspective view of an apparatus body in the printer according to the invention.
Figure 5:
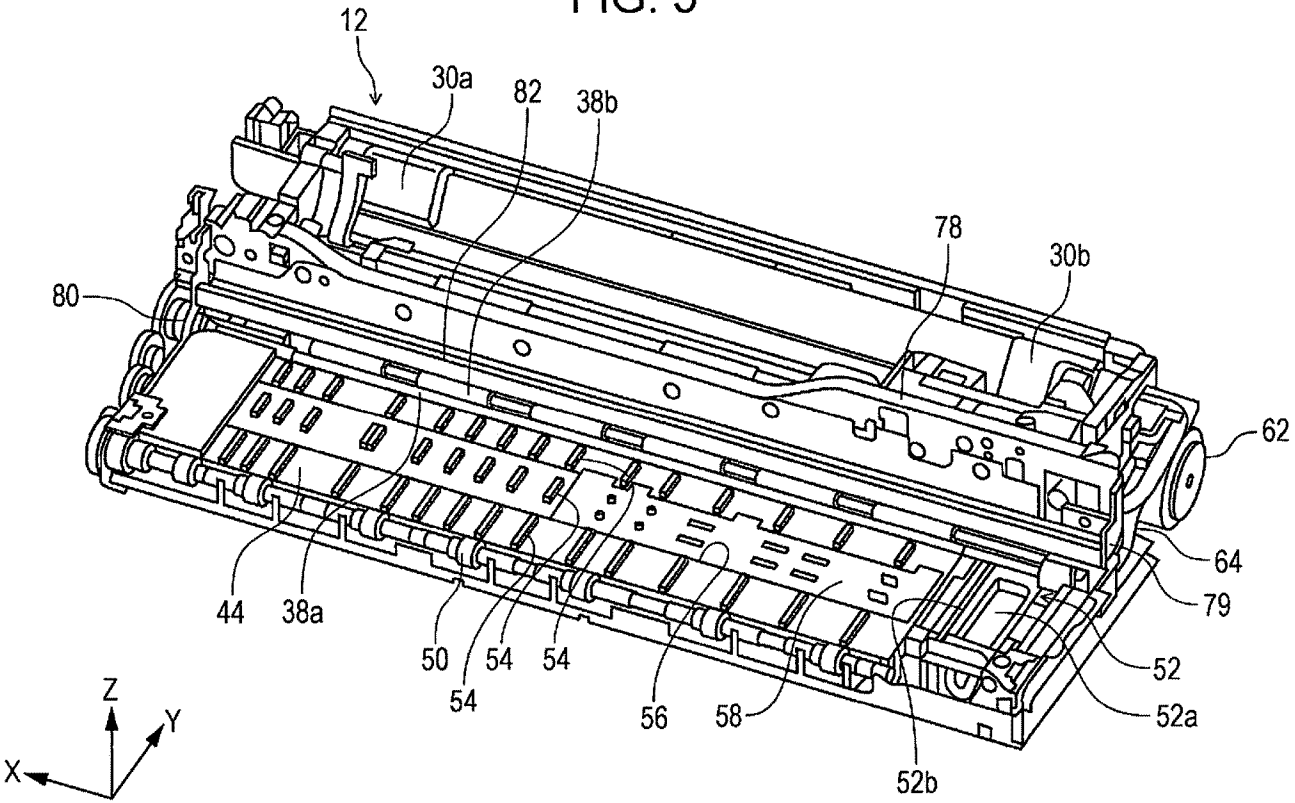
FIG. 5 is a perspective view illustrating a platen and a cap provided in the apparatus body.
Figure 6:
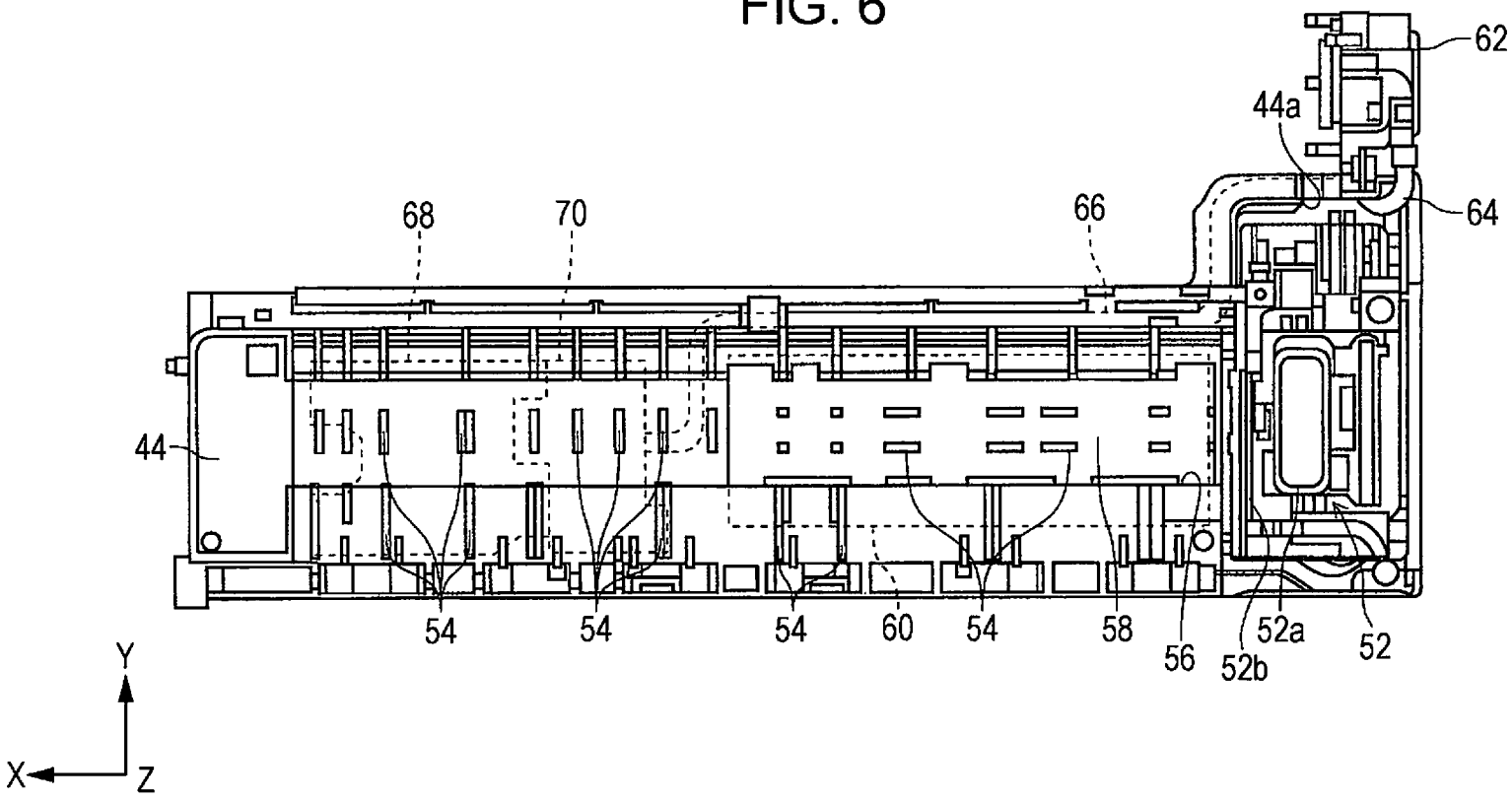
FIG. 6 is a plane view of the platen and the cap seen from above.

FIG. 1 is an appearance perspective view in a state in which a cover is closed in a printer according to the invention, FIG. 2 is an appearance perspective view in a state in which the cover is opened in the printer according to the invention, FIG. 3 is a side cross-sectional view illustrating a medium transporting route in the printer according to the invention, FIG. 4 is an appearance perspective view of an apparatus body in the printer according to the invention, FIG. 5 is a perspective view illustrating a platen and a cap provided in the apparatus body, and FIG. 6 is a plane view of the platen and the cap seen from above.

Figure 7:
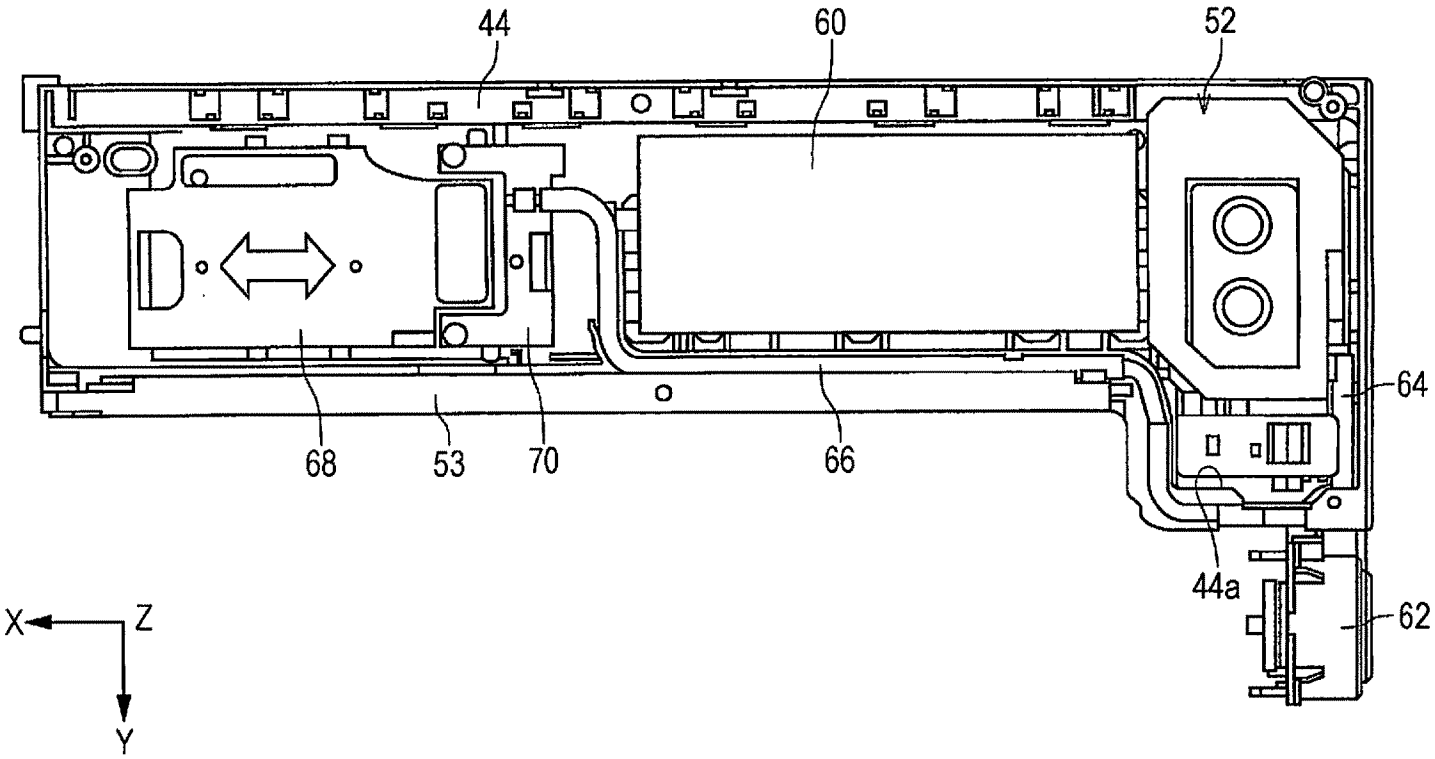
FIG. 7 is a plane view of the platen and the cap seen from below.
Figure 8:
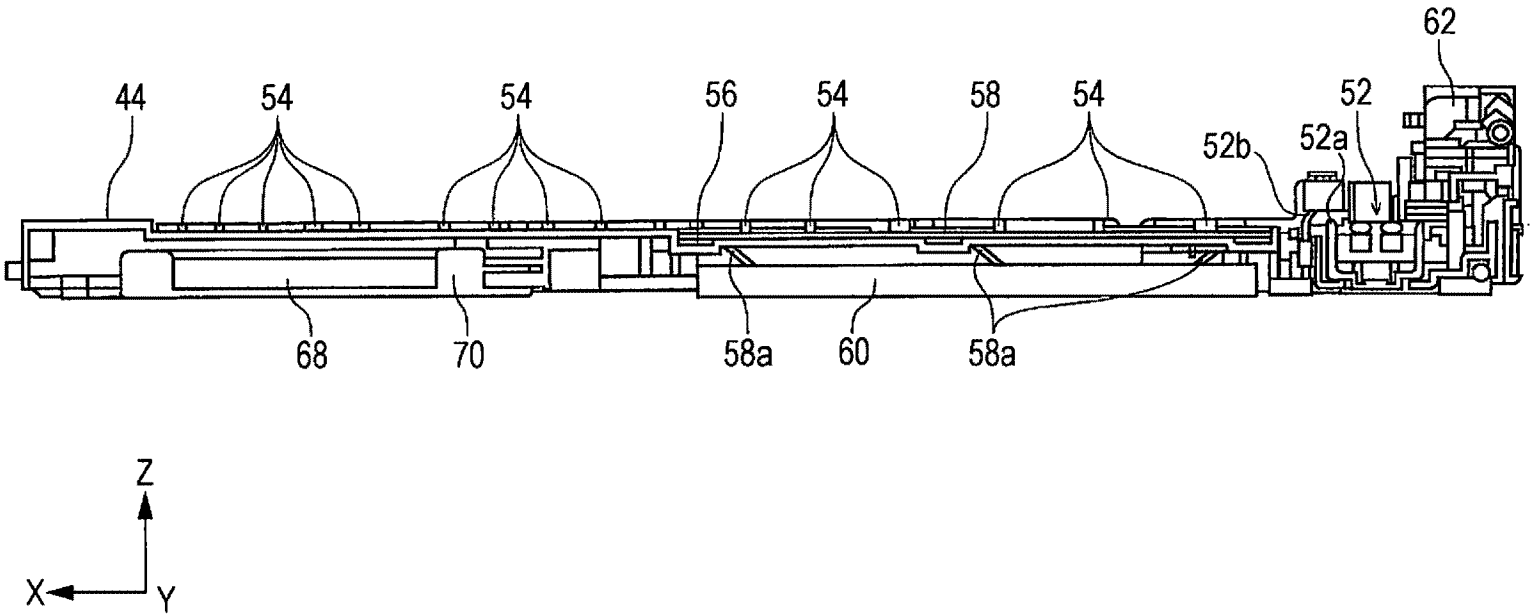
FIG. 8 is a side cross-sectional view of the platen and the cap.
Figure 9:
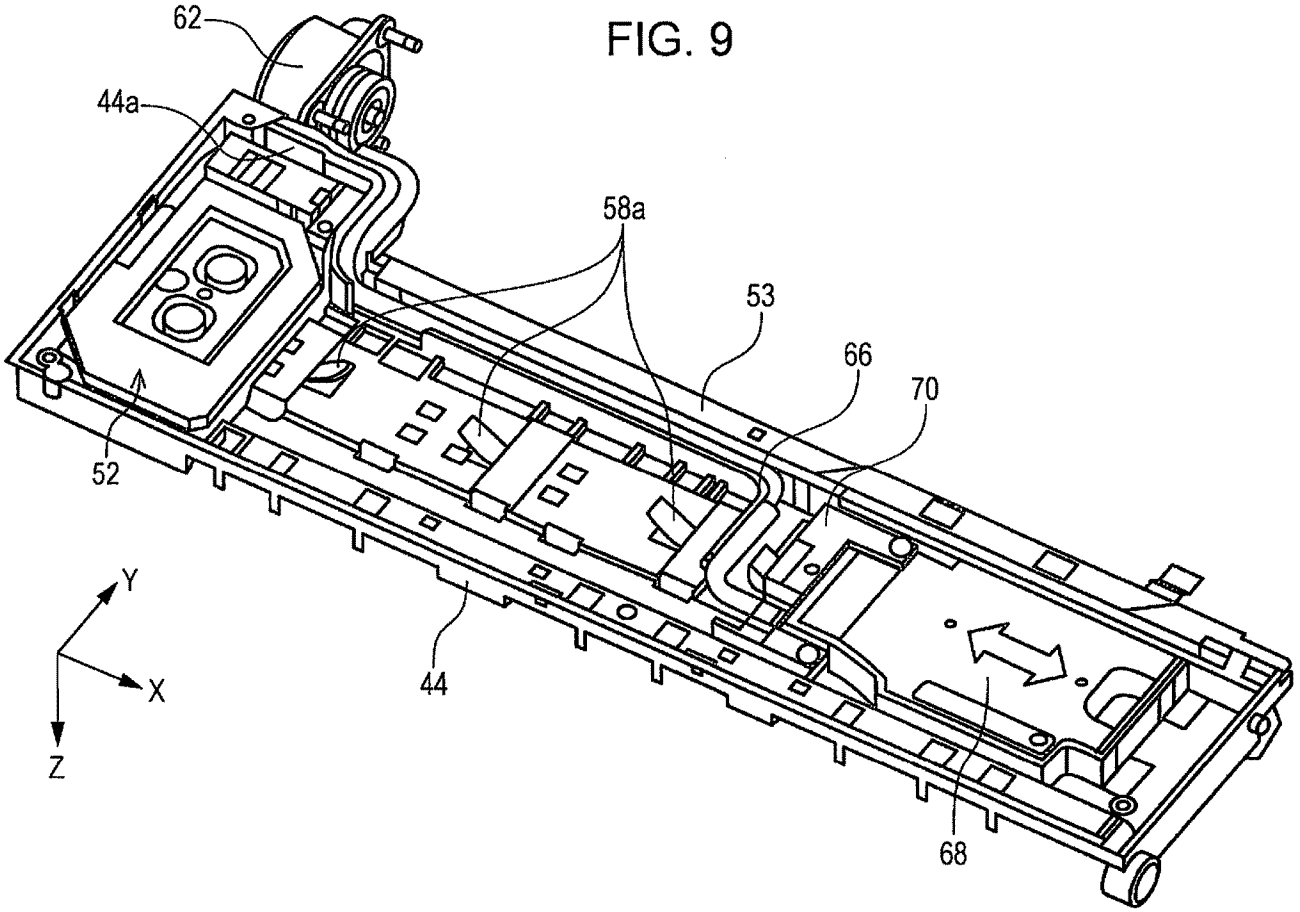
FIG. 9 is a perspective view of the platen and the cap seen from below.
Figure 10:
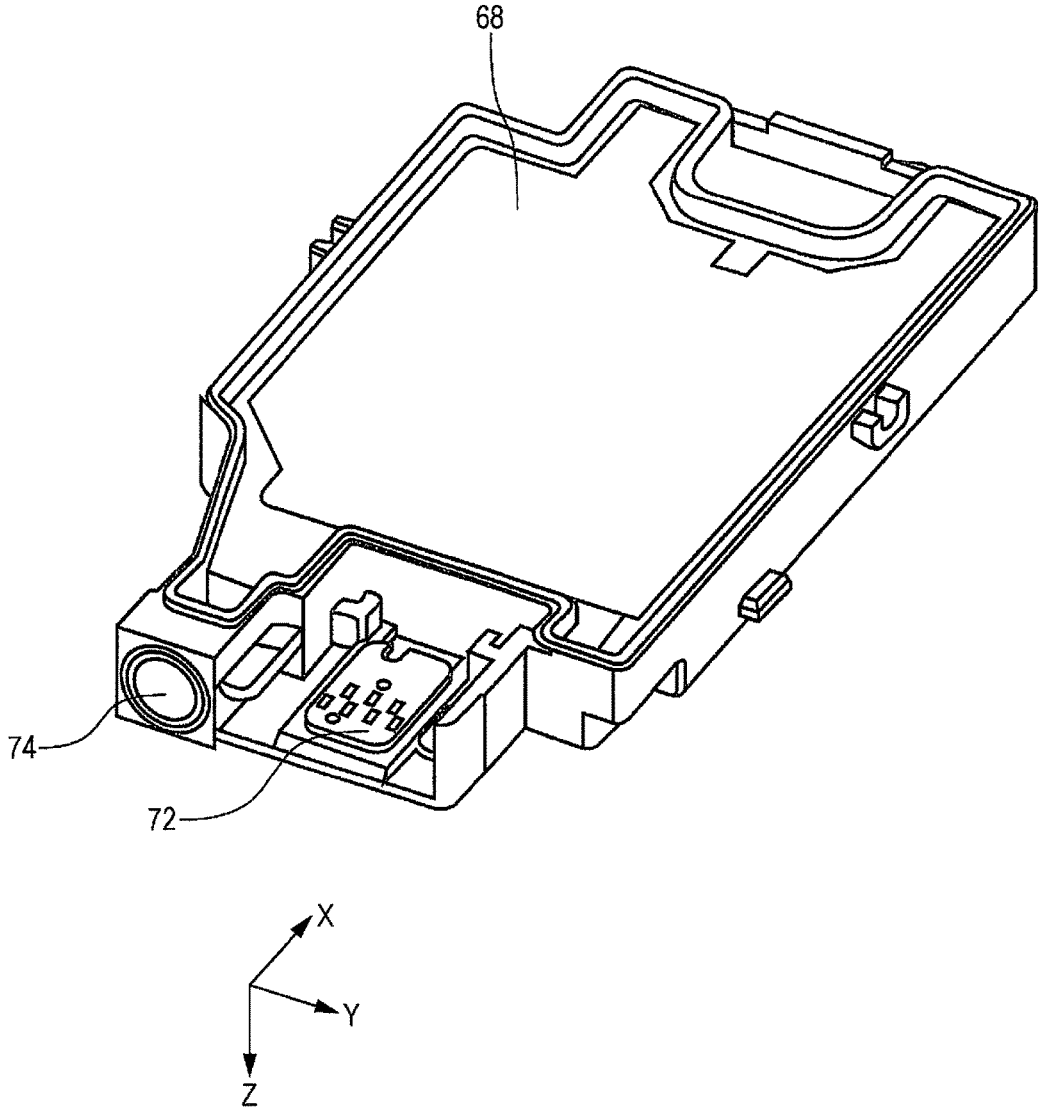
FIG. 10 is a perspective view of a waste liquid ink cartridge.
Figure 11:
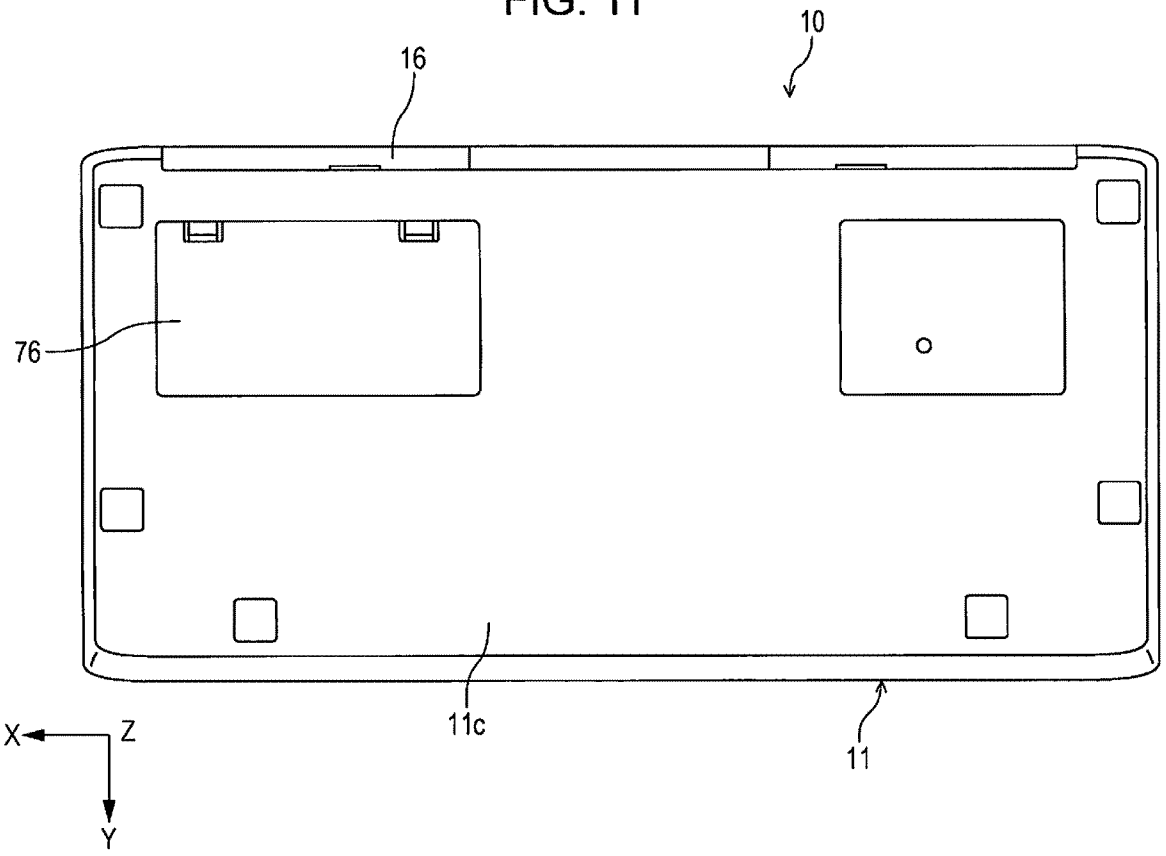
FIG. 11 is a plane view of the printer in a state in which the over is attached to a waste liquid ink cartridge storing portion seen from below.
Figure 12:
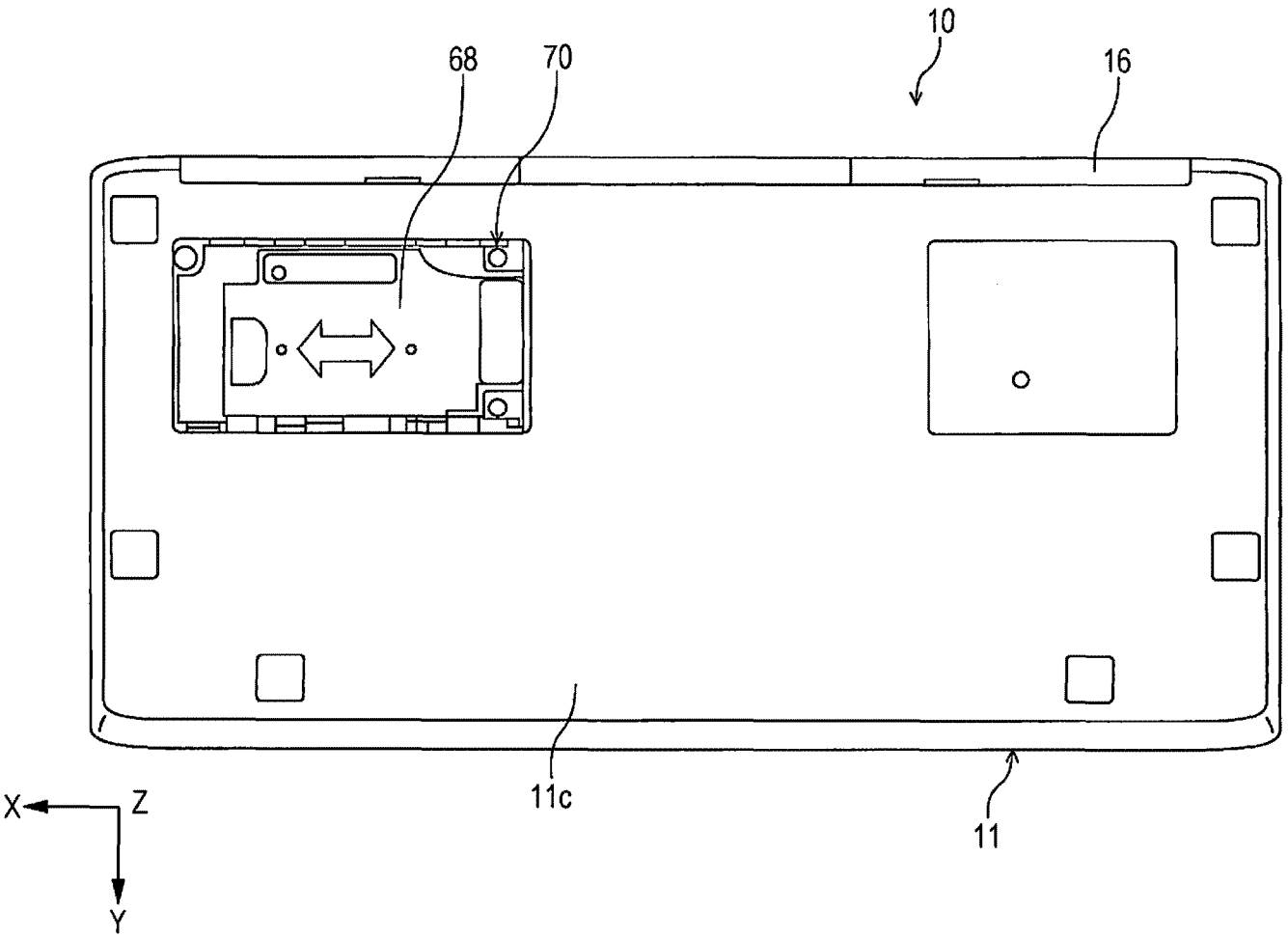
FIG. 12 is a plane view of the printer in a state in which the waste liquid ink cartridge is stored in the waste liquid ink cartridge storing portion seen from below.
Figure 13:
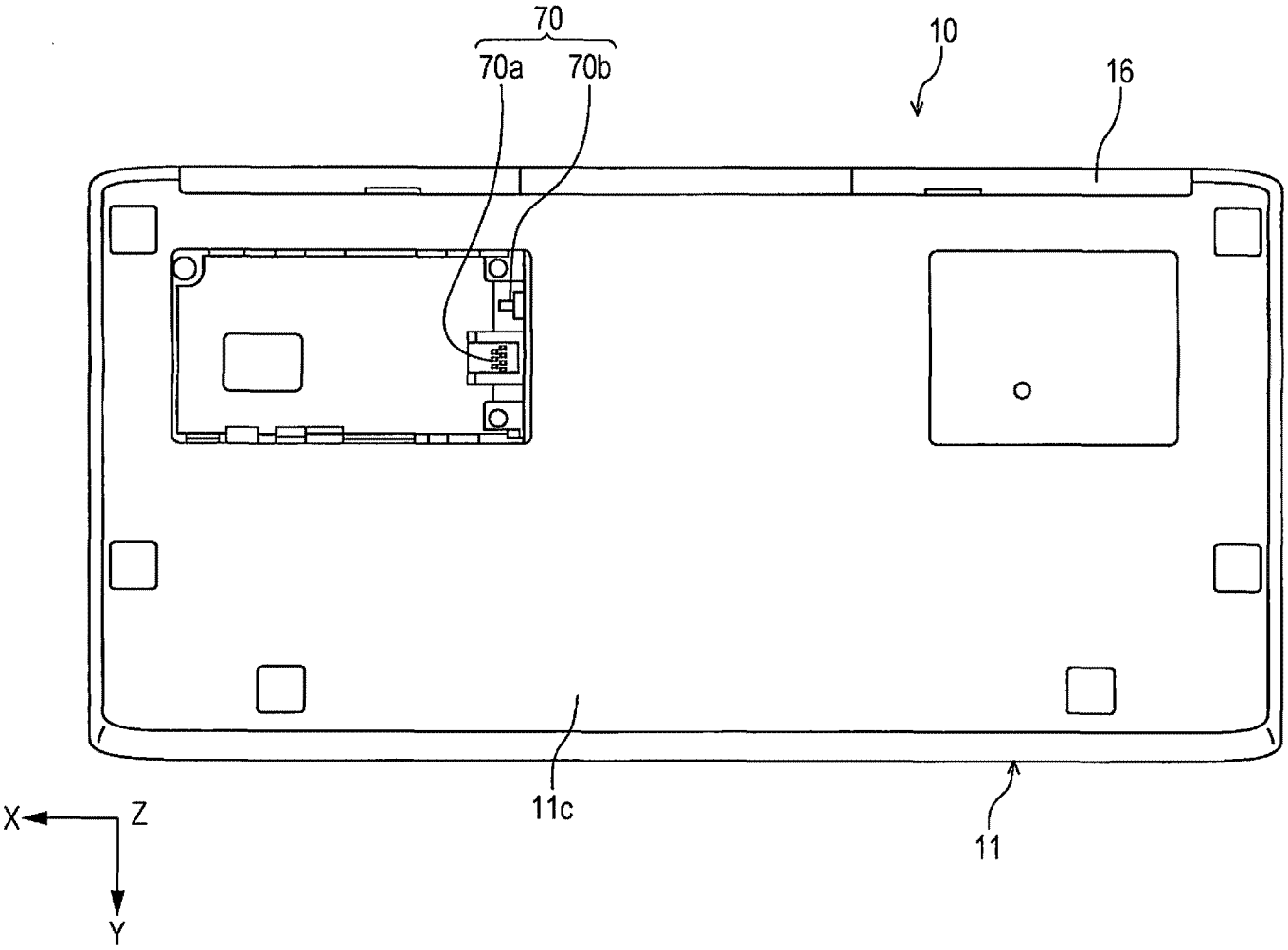
FIG. 13 is a plane view of the waste liquid ink cartridge storing portion.

FIG. 7 is a plane view of the platen and the cap seen from below, FIG. 8 is a side cross-sectional view of the platen and the cap, FIG. 9 is a perspective view of the platen and the cap seen from below, FIG. 10 is a perspective view of a waste liquid ink cartridge, FIG. 11 is a plane view of the printer in a state in which the cover is attached to a waste liquid ink cartridge storing portion seen from below, FIG. 12 is a plane view of the printer in a state the waste liquid ink cartridge is stored in the waste liquid ink cartridge storing portion seen from below, and FIG. 13 is a plane view of the waste liquid ink cartridge storing portion.

Figure 14:
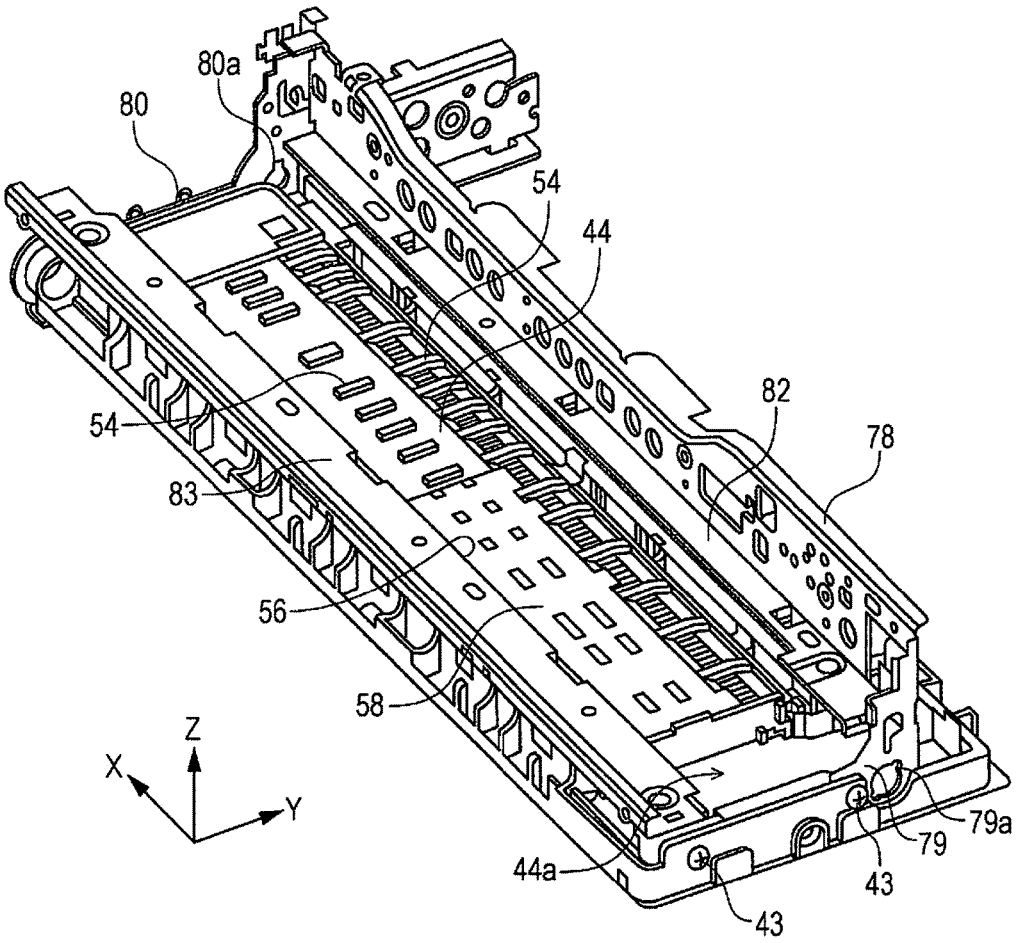
FIG. 14 is a perspective view in a state in which the platen is attached to a frame configuring the apparatus body.
Figure 15:
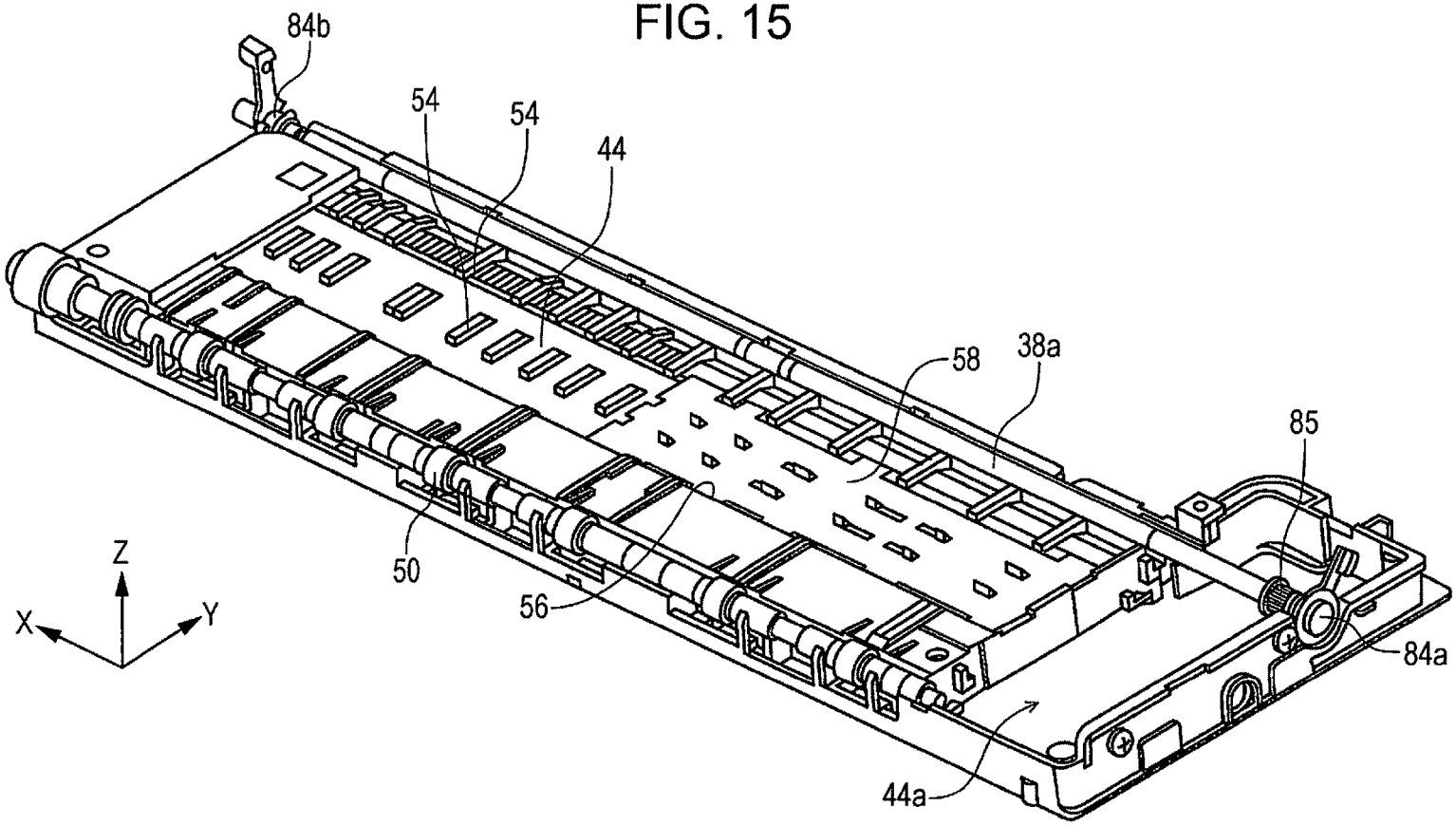
FIG. 15 is a perspective view of the platen, a transporting driving roller, and an ejecting driving roller.
Figure 16:
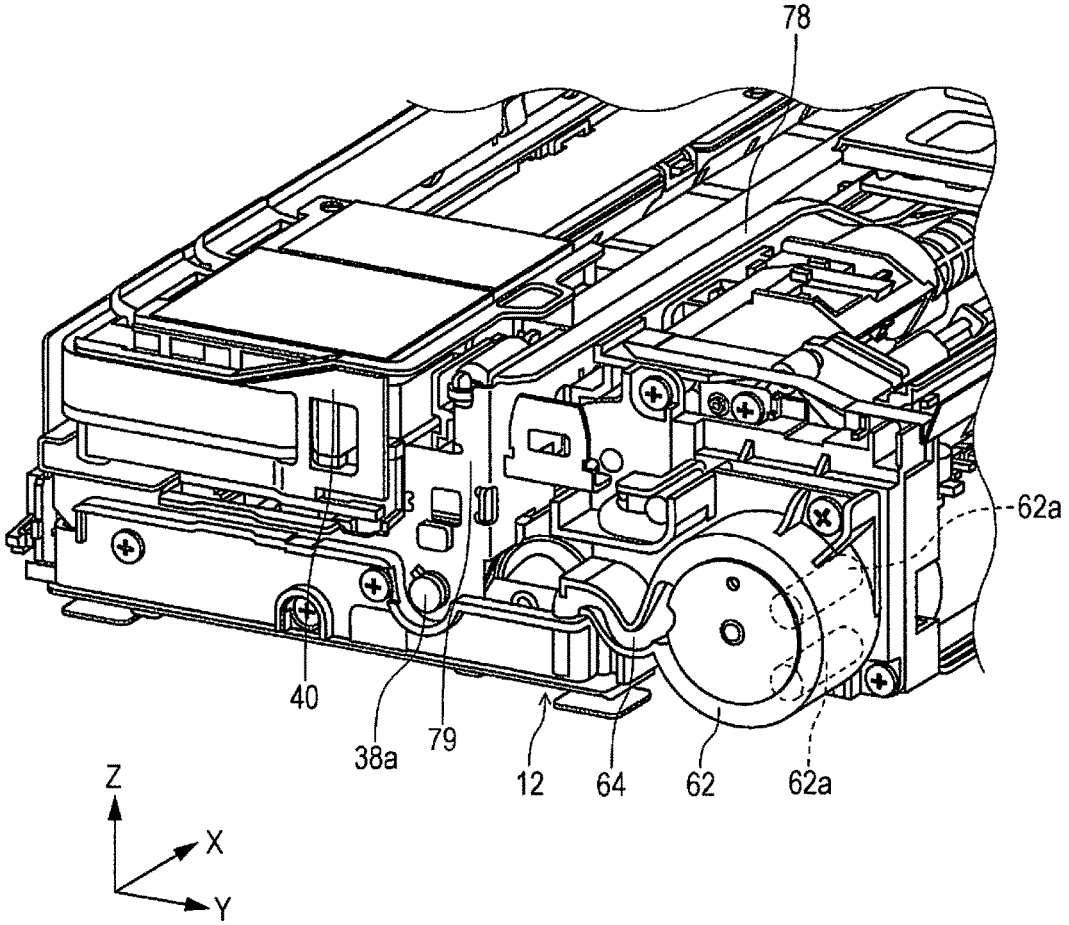
FIG. 16 is a partial enlarged perspective view of the apparatus body seen from a pump side.
Figure 17:
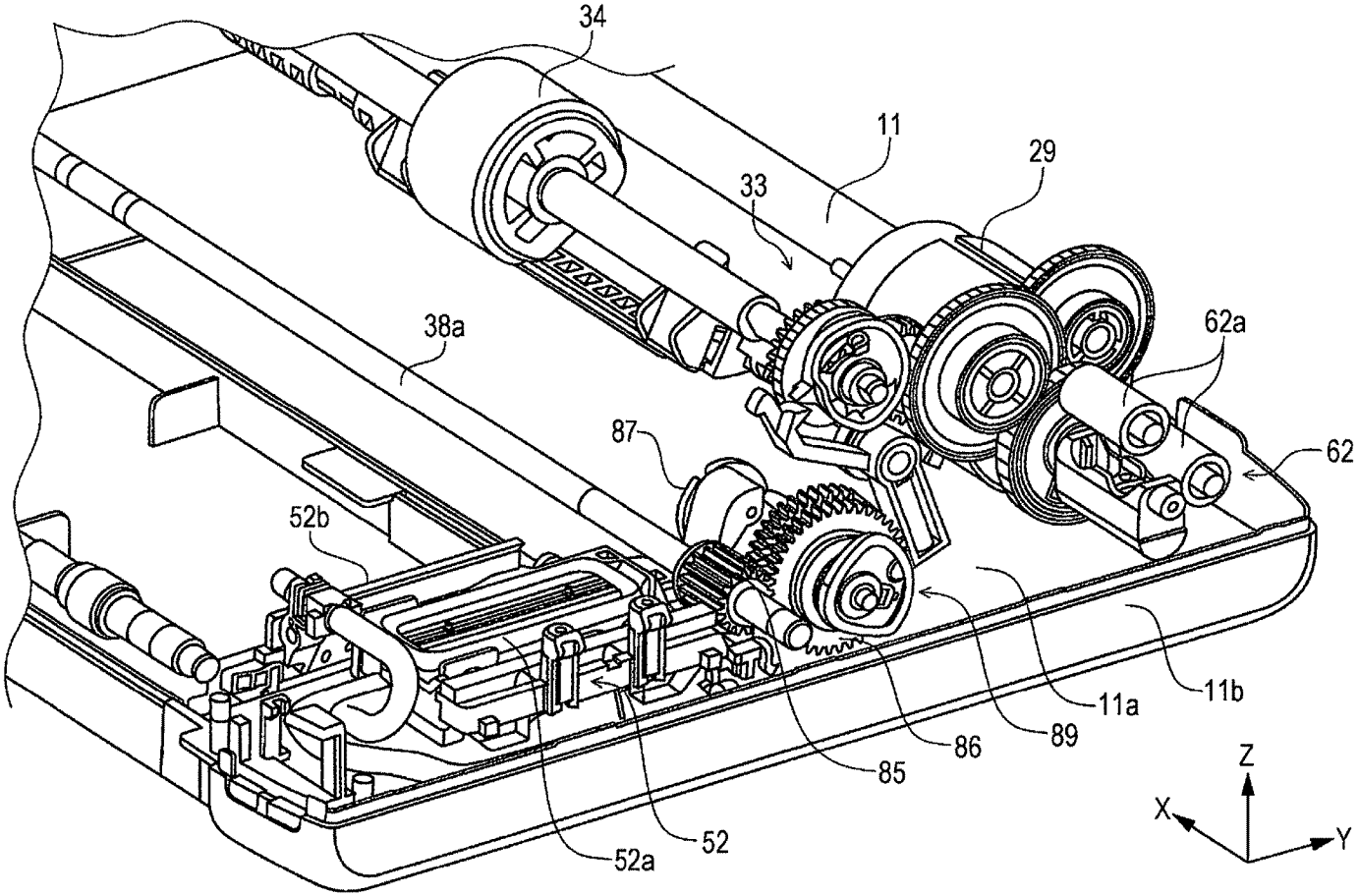
FIG. 17 is a perspective view of a cap unit, the transporting driving roller, the power transmitting unit, and the pump.
Figure 18:
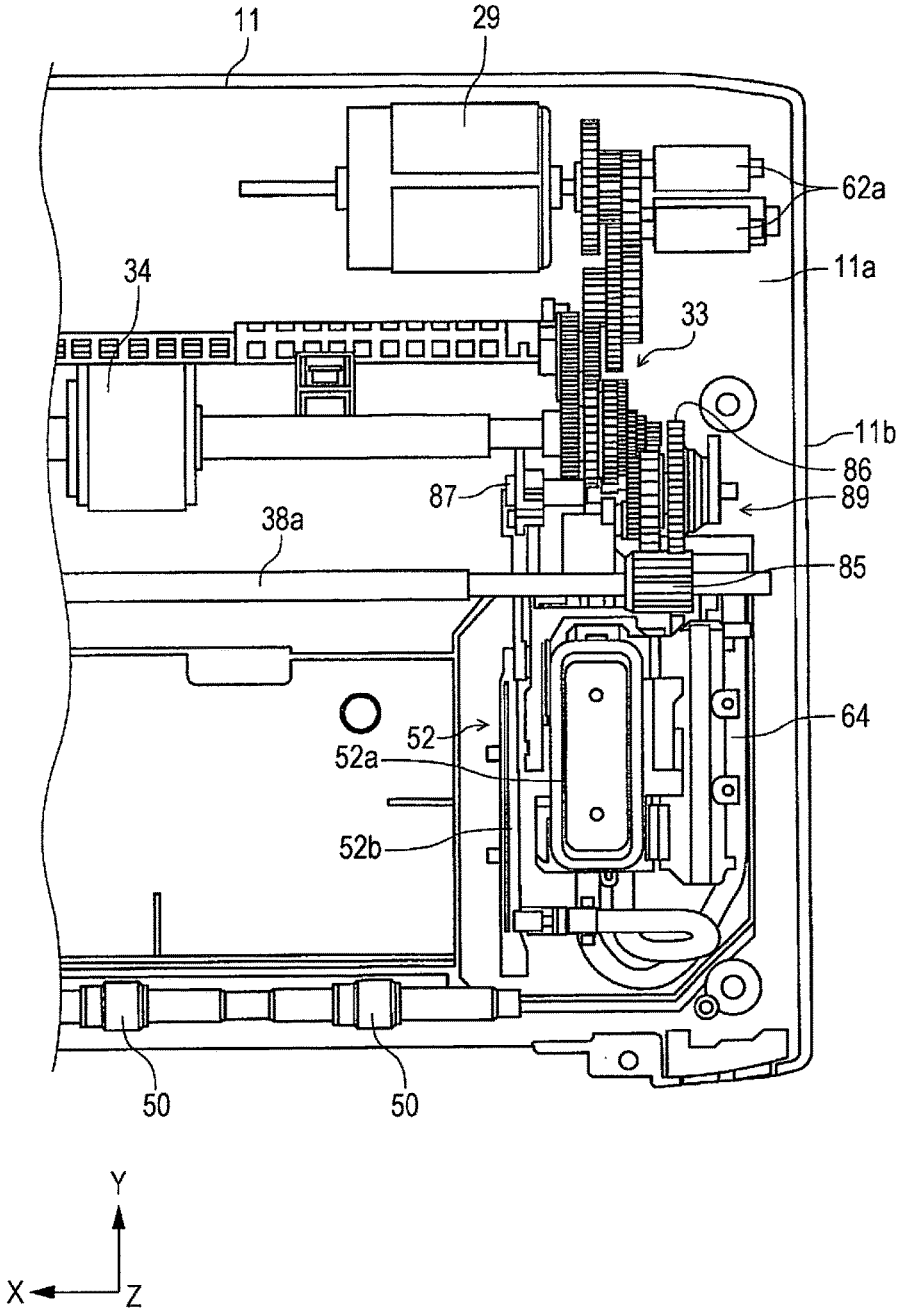
FIG. 18 is a plane view of a cap unit, the transporting driving roller, the power transmitting unit, and the pump.
Figure 19:
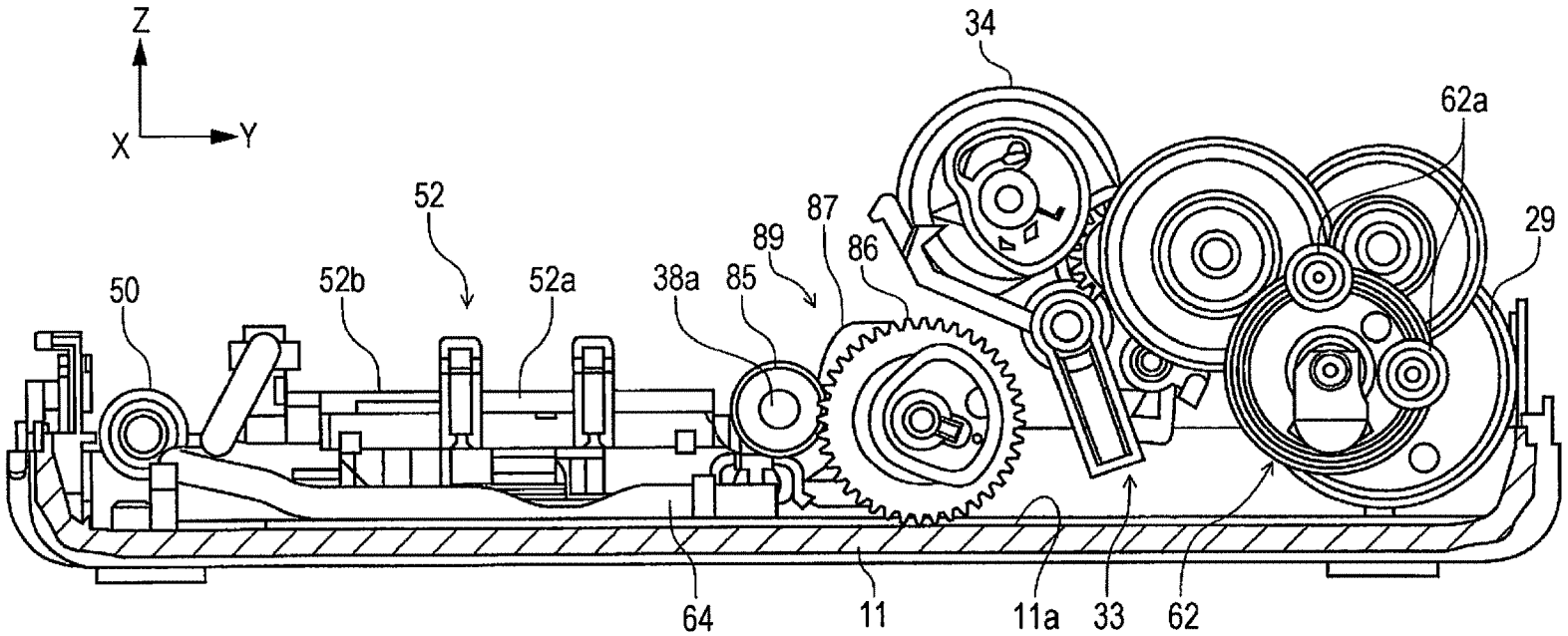
FIG. 19 is a front view of a cap unit, the transporting driving roller, the power transmitting unit, and the pump.

In addition, FIG. 14 is a perspective view in a state in which the platen is attached to a frame configuring the apparatus body, FIG. 15 is a perspective view of the platen, a transporting driving roller, and an ejecting driving roller, FIG. 16 is a partial enlarged perspective view of the apparatus body seen from a pump side, FIG. 17 is a perspective view of a cap unit, the transporting driving roller, the power transmitting unit, and the pump, FIG. 18 is a plane view thereof, FIG. 19 is a front view thereof.

Meanwhile, in an X-Y-Z coordinate system shown in each figure, an X direction is a scanning direction of the recording head, is also a rotational axis line direction of the transporting driving roller, or is also a lateral width direction of the apparatus. In addition, a Y direction is a depth direction of the recording apparatus or is also a direction orthogonal to a rotational axis line direction of the transporting driving roller. Furthermore, a Z direction indicates a direction in which a distance (a gap) between the recording head and the medium is changed, that is, a height direction of the apparatus. Meanwhile, in each figure, a −Y direction is set to the front face side of the apparatus and the +Y direction side is set to the back face side of the apparatus. Furthermore, a −X direction is set to the right side of the apparatus and a +X direction is set to the left side of the apparatus. Meanwhile, a −X direction is also a home position side of the carriage.

Outline of Printer

Constituent elements of an ink jet printer 10 (hereinafter, referred to as a "printer 10") as an example of the recording apparatus will be summarized with reference to FIGS. 1 to 5, FIG. 14, and FIG. 15. The printer 10 includes an apparatus body 12 (refer to FIG. 4), an upper housing 14 and a lower housing 11 which cover a periphery of the apparatus body 12 and configure an appearance of the printer 10, a cover 16 which is openable and closable with respect to the apparatus body 12, and an operation portion 18 which is exposed to the upper part of the apparatus body 12 in a posture in which the cover 16 is opened.

The cover 16 configures a part of the upper face and the front face of the printer 10 in a state in which the cover 16 is closed. The cover 16 is rotatably attached with respect to the apparatus body 12. When the cover 16 is rotated in a counterclockwise direction in FIG. 2, from the forward side of the apparatus (a −Y-axis direction in FIG. 2) toward the backward side of the apparatus (a +Y-axis direction in FIG. 2) with respect to the apparatus body 12, the cover 16 is in a posture of being open as shown in FIG. 2. In Example, when the cover 16 is in a posture of being open with respect to the apparatus body 12 as shown in FIG. 2, the inner face of the cover 16 functions as a mounting surface 16*a* of a paper P as a "medium".

In addition, when the posture of the cover 16 is changed from a posture in which the cover 16 is closed (refer to FIG. 1) to a posture in which the cover 16 is opened as shown in FIG. 2, the operation portion 18 and a paper supply port 20 are exposed to the upper part of the apparatus body 12 and a discharge port 22 is exposed to the front face of the apparatus body 12. The operation portion 18 is configured by including a power button or a printing setting button for operating the printer 10, a display panel, or the like.

In addition, when the paper P is mounted on the mounting surface 16*a* of the cover 16, the paper supply port 20 supplied the paper P from the mounting surface 16*a* to the inside of the apparatus body 12. In addition, the discharge port 22 allows the paper P supplied from the mounting surface 16*a* into the apparatus body 12 through the paper supply port 20 to be discharged to the front face side of the apparatus (the −Y-axis direction side in FIG. 2) in a state in which recording is executed by a recording portion 24 described later.

Next, constituent elements on a paper transporting route will be described in more detail with reference to FIGS. 3 to 5. In FIG. 3, the right side on the paper (the back face side of the apparatus) is an upstream of a feeding route and the left side on the paper (the front face side of the apparatus) is a downstream of a feeding route. In addition, a dashed line in which a sign 26 is written in FIG. 3 indicates a transporting route of the paper P.

A paper supply portion 28 for feeding a paper from the mounting surface 16*a* of the cover 16 in a state of being open with respect to the upper housing 14 to the downstream side of the feeding route is provided on the upstream side of the feeding route. The paper supply portion 28 includes the paper supply port 20, a pair of paper guides 30 which are provided on the paper supply port, a paper supporting portion 32 for supporting at least a part of the paper inputted from the paper supply port 20, and a feeding roller 34 which is provided at a position opposed to the paper supporting portion 32. Meanwhile, the cover 16 and the paper supporting portion 32 support the paper P in an inclined posture.

The pair of paper guides 30 include a paper guide 30*a* which is positioned on the +X-axis direction side and a paper guide 30*b* which is positioned on the −X-axis direction side in an X-axis direction in FIG. 2, FIG. 4, and FIG. 5. The paper guide 30*a* is movably configured so as to be able to approach and separate along an X direction with respect to the paper guide 30*b* positioned on the −X-axis direction side. That is, the paper guide 30*a* is provided so that a user can carry out slide operation in a width direction of the paper (an X direction) in accordance with a size of the paper.

The paper supporting portion 32 is formed in a downward inclined shape toward the −Y direction side in FIG. 3. In addition, the feeding roller 34 is oscillatably configured in approaching/separating directions with respect to the paper P mounted on the paper supporting portion 32. When the feeding roller 34 is displaced in a direction of approaching the paper supporting portion 32, the feeding roller 34 comes into contact with an uppermost paper P mounted on the paper supporting portion 32 and feeds the uppermost paper P to the downstream side of the supply route.

A pair of transporting rollers 38 are provided on the downstream side of the paper supply portion 28. The pair of transporting rollers 38 are configured by including a transporting driving roller 38*a* which is rotationally driven by a motor (not shown) and a transporting driven roller 38*b* which nips the paper P between the transporting driving roller 38*a* and the transporting driven roller 38*b* to be rotationally driven to rotate. The pair of transporting rollers 38 nips the paper P which is fed from the paper supply portion 28 and transports the paper P to the downstream side in the transporting direction. The recording portion 24 is provided on the downstream side of the pair of transporting rollers 38.

In the embodiment, the diameter of the transporting driving roller 38*a* is smaller than the diameter of the transporting driven roller 38*b*. Here, a rotary scale (not shown) is attached to a shaft end of the transporting driving roller 38*a*. In the embodiment, since the diameter of the transporting driving roller 38*a* is formed small, it is also possible to set the diameter of the rotary scale to be small. Accordingly, it is possible to lower the height position of the transporting driving roller 38*a* and thus, it is possible to attain the suppression of the dimension in a height direction of the apparatus.

Subsequently, the recording portion 24 includes a the carriage 40, a recording head 42 provided on a bottom part of the carriage, and a platen 44 which is opposed to the recording head and functions as a "medium supporting portion" for supporting the medium. The recording head 42 can be opposed to the paper P supported by the platen 44. The carriage 40 reciprocates in an X-axis direction by a carriage driving motor 46 (refer to FIG. 4) which is controlled by a control portion (not shown) provided inside the apparatus body 12. In addition, the platen 44 defines a distance (a gap) between a recording face of the medium and a head face of the recording head 42 by supporting the paper P from below.

In the recording portion 24, when the paper P supported by the platen 44 is opposed to the recording head 42, recording is executed by discharging ink as "liquid" from a plurality of nozzle holes (not shown) of the recording head 42 toward the paper P and landing the ink on a recording face (a face opposed to the recording head 42) of the paper P.

Here, a frame configuration configuring a skeleton of the apparatus body 12 will be described with reference to FIG. 14. The skeleton of the apparatus body 12 is configured with a main frame 78, a side frame 79, a side frame 80, a sub frame 81, a guide frame 82, and a guide frame 83. Meanwhile, FIG. 5 and FIG. 14 respectively illustrate a state in which the guide frame 83 and the sub frame 81 are removed and a state in which the sub frame 81 is removed.

The main frame 78, the sub frame 81, and the guide frames 82 and 83 have a shape extending in a width direction of the paper and the side frames 79 and 80 have a shape extending in a transporting direction of the paper.

The main frame 78 extends in a vertical direction in a cross-sectional view as shown in FIG. 3, the upper part thereof has a shape bent to the rear side of the apparatus into an L shape, and the lower part thereof has a shape bent to the forward side of the apparatus into an L shape. Various kinds of constituent members such as the carriage driving motor 46 for driving the carriage 40 are assembled to the main frame 78.

The side frames 79 and 80 are positioned on both sides of a moving region of the carriage 40 and are respectively bonded with the end parts of the guide frames 82 and 83, and various kinds of elements configuring the paper transporting route such as the transporting driving roller 38*a* or the platen 44 are assembled thereto. In FIG. 14, a signs 43 and 43 are screws for fixing the platen 44 with respect to the side frame 79. In the same manner, the platen 44 is fixed with respect to the side frame 80 by a screw not shown in FIG. 14 (angularly hidden).

Meanwhile, a hole 79*a* is formed on the side frame 79 and a hole 80*a* is formed on the side frame 80 as shown in FIG. 14. The transporting driving roller 38*a* is supported by the holes 79*a* and 80*a* through bearing members 84*a* and 84*b* (FIG. 15).

On the other hand, the function of the guide frames 82 and 83 is as follow. That is, the carriage 40 has a first supported portion 40*a* on the front side of the apparatus and a second supported portion 40*b* on the back side of the apparatus, as shown in FIG. 3. The first supported portion 40*a* is supported by the guide frame 83 and the second supported portion 40*b* is supported by the guide frame 82. That is, the guide frame 83 and the guide frame 82 support the carriage 40.

Meanwhile, the first supported portion 40*a* is supported by the guide frame 83 and slides on the guide frame 83. In addition, the second supported portion 40*b* is supported by the guide frame 82 and slides on the guide frame 82. That is, the guide frame 82 guides a carriage 17 in a main scanning direction. Furthermore, the guide frame 82 defines a Y direction position of the carriage 17.

Referring back to FIG. 3, a discharge portion 48 is provided on the downstream side in a transporting direction of the recording portion 24. The discharge portion 48 includes a discharging driving roller 50 and a discharging driven roller 49. The paper P on which recording is executed in the recording portion 24 is nipped by the pair of rollers and is discharged from the discharge port 22 (FIG. 2) formed on the front face of the apparatus toward the forward of the apparatus. Meanwhile, the pair of discharging driving rollers 50 is rotationally driven by a driving motor (not shown).

As to Platen, Waste Ink Cartridge, and Ink Absorber

Next, configurations and arrangements of the platen 44, a waste ink cartridge 68, and an ink absorber 60 will be described with reference to FIG. 4 to FIG. 9.

Firstly, the carriage 40 is movably configured between the end part of the −X-axis direction side and the end part of the +X-axis direction side in the apparatus body 12 as shown in FIG. 4. That is, the region between the end part of the −X-axis direction side and the end part of the +X-axis direction side becomes a moving region of the carriage 40 in the apparatus body 12. Meanwhile, in Example, the end part of the −X-axis direction side in the moving region of the carriage 40 is set to the home position.

The platen 44 is arranged on the downward side of the carriage 40, that is, on the −Z-axis direction side in the moving region of the carriage 40 as shown in FIG. 5. In addition, a cap unit 52 is provided on the end part of the −X-axis direction side of the apparatus body 12, that is, on the home position side in the moving region of the carriage 40.

In addition, a reinforcing member 53 which extends in an X-axis direction is attached to the end part of the +Y-axis direction side on the lower face of the platen 44, as shown in FIG. 7. In Example, the reinforcing member 53 is formed with a quality of material having high rigidity, which is a metal material or the like as an example. The reinforcing member 53 suppresses the deflection of the platen 44 in an X direction. Therefore, it is possible to keep the distance (the gap) between the recording head 42 and the platen 44 in the moving region of the carriage 40 at a certain distance.

A plurality of ribs 54 which support the paper P are provided on the upper face of the platen 44 at intervals in an X-axis direction and in an Y-axis direction. In addition, a concave portion 56 is provided as a "liquid receiving portion" in a part of the region in an X-axis direction of the platen 44 and the ink absorber 58 is arranged on the concave portion 56. In Example, the concave portion 56 is provided near the end part of the −X-axis direction side in an X-axis direction which is a direction intersecting with a Y-axis direction which is a transporting direction of the paper P.

Here, in the printer 10, the paper P in which recording can be executed, includes not only a plain paper but also a large-sized photographic paper, a postcard, or the like. The printer 10 in Example is configured so as to be able to execute marginless recording in which recording is executed on an entire face of a recording face of a paper having a small size (hereinafter, referred to as a "small-sized paper") such as a large-sized photographic paper or a postcard.

The lengths in an X-axis direction of the concave portion 56 and the ink absorber 58 in Example are set to a length in which marginless recording can be executed on the small-sized paper in the printer 10. That is, the concave portion 56 and the ink absorber 58 are configured so as to be positioned in the region deviating from the end part of the small-sized paper.

In addition, in Example, the ink absorber 58 is configured with a sponge material. That is, the ink absorber 58 arranged on the concave portion 56 can absorb ink abandoned in the region deviating from the end part of the small-sized paper and can temporarily hold the ink when marginless recording is executed.

In addition, a plurality of holes are provided on the bottom face of the concave portion 56. The ink absorber 58 includes a plurality of tongue pieces 58*a* (refer to FIG. 8 and FIG. 9) which extend in the lower side of the platen 44 through the holes. The plurality of tongue pieces 58*a* abuts on an ink absorber 60 as a "first liquid holding portion" which is arranged in a region in which the concave portion 56 of the platen 44 is provided, that is, on the lower side (the −Z-axis direction side) in a region in which the ink absorber 58 is arranged.

The ink absorber 60 is arranged below the platen 44 as shown in FIG. 7 and FIG. 8. In addition, the ink absorber 60 is provided corresponding to the length of the concave portion 56 (the ink absorber 58) in an X-axis direction in FIG. 7 and FIG. 8. Meanwhile, in Example, the ink absorber 60 is configured with a sponge material in the same manner as the ink absorber 58.

In Example, after the abandoned ink is once absorbed in the ink absorber 58 arranged on the upper face side of the platen 44 when marginless recording is executed on the small-sized paper, the ink is led from the upper side to the lower side of the platen 44 through the tongue pieces 58*a* and is absorbed and held in the ink absorber 60 abutting on the tongue pieces 58*a*.

In Example, since the ink absorber 60 is provided below the concave portion 56 receiving the ink ejected in the region deviating from the end part of the paper P, it is possible to promptly discharge a liquid from the concave portion 56 to the ink absorber 60.

Meanwhile, the ink absorber 60 is arranged on the concave portion provided on the inner side bottom face of the lower housing 11 (not shown). It is possible to suppress the leak of ink absorbed in the ink absorber 60 into the apparatus body 12 by arranging the ink absorber 60 on the concave portion.

When FIG. 5 to FIG. 7 are referred again, an opening 44*a* is provided on the end part of the −X-axis direction side in the platen 44 and the cap unit 52 is provided on the opening

44*a* as the "maintenance portion". Meanwhile, the opening 44*a* is also illustrated in detail in FIG. 15.

In addition, in the apparatus body 12, a pump 62 is provided in the −Y-axis direction side of the cap unit 52. The pump 62 is connected to the cap unit 52 by a waste ink tube 64.

The cap unit 52 includes a cap 52*a* and a blade 52*b* and is displaceably provided in a vertical direction (a Z-axis direction). That is, when the carriage 40 is positioned at the home position, the cap unit 52 is configured so as to be able to be placed at a sealing position in which the cap 52*a* is opposed to the recording head 42, is displaced upward, and seals a nozzle forming face (not shown) of the recording head 42 to prevent ink from drying and at a separation position in which the cap 52*a* is separated from the recording head 42. That is, the cap unit 52 is capable of being advanced and retracted with respect to the recording head 42.

In addition, in a case where the cap 52*a* is at the sealing position in which the cap 52*a* seals the recording head 42, when the pump 62 is driven, the cap 52*a* generates negative pressure in the cap unit 52 through the waste ink tube 64. The suction of ink from the nozzle of the recording head 42 is performed by the negative pressure and it is possible to eliminate the clogging or the mixing of air bubbles of the nozzle.

In addition, while recording operation is executed in the printer 10, a flushing operation is performed at fixed timing. The flushing operation is an operation which makes the carriage 40 temporarily move to the home position and ejects and abandons the ink toward the cap 52*a*.

The waste ink generated in the cap unit 52 is sucked through the waste ink tube 64 by the pump 62. Moreover, the sucked waste ink is stored in a waste ink cartridge 68 as a "second liquid holding portion" which is connected to a waste ink tube 66 extending from the pump 62.

The blade 52*b* wipes a nozzle face of the recording head 42 and wipes a nozzle forming face of the blade 52*b* when the recording head 42 is moved from a recording region side (the +X-axis direction side) to the home position side (the −X-axis direction side).

Next, a layout of the waste ink tube 66 and an arrangement in the platen 44 of the waste ink cartridge 68 will be described with reference to FIGS. 6 to 9. A cartridge mounting portion 70 in which the waste ink cartridge 68 is attachable and detachable is provided on the lower side (the −Z-axis direction side) of the platen 44. The waste ink cartridge 68 is arranged near the end part of the +X-axis direction side of the platen 44 on the lower side of the platen 44 in a state of being connected to the cartridge mounting portion 70.

That is, the waste ink cartridge 68 is arranged in parallel with the ink absorber 60 in a Y-axis direction in a state of being connected to the cartridge mounting portion 70. In addition, one end of the waste ink tube 66 is connected to the pump 62 and the other end is connected to the cartridge mounting portion 70.

The waste ink tube 66 is pulled around on the lower side (the −Z-axis direction side) of the platen 44. Specifically, the waste ink tube 66 drawn out from the pump 62 passes between the reinforcing member 53 and the ink absorber 60 on the end part of the +Y-axis direction side of the platen 44 and extends in a +X-axis direction.

That is, the waste ink tube 66 extends from a −X-axis direction toward a +X-axis direction on the end part of the platen 44 on the +Y-axis direction side. Moreover, the waste ink tube 66 passes between the ink absorber 60 and the cartridge mounting portion 70, that is, the waste ink cartridge 68 in an X-axis direction, extends in the −Y-axis direction side, and is connected to the cartridge mounting portion 70 at a position opposed to the ink absorber 60 in the cartridge mounting portion 70 (the waste ink cartridge 68) as shown in FIGS. 6 and 7.

Therefore, a state in which the cap unit 52 and the waste ink cartridge 68 are communicated with each other through the waste ink tube 66, the pump 62, and the waste ink tube 64 is attained in a state in which the waste ink cartridge 68 is connected to the cartridge mounting portion 70. As a result, it is possible to hold the ink which is abandoned in the cap unit 52 and is sent from the pump 62 in the waste ink cartridge 68.

In Example, since the waste ink tube 64 connecting the pump 62 and the waste ink cartridge 68 passes between the ink absorber 60 and the waste ink cartridge 68 and is connected to a position opposed to the ink absorber 60 in the waste ink cartridge 68, there is no need to secure a region for disposing the waste ink tube 64 outside the waste ink cartridge 68 and thus, it is possible to attain the miniaturization of the printer 10.

Moreover, in Example, the waste ink cartridge 68 and the ink absorber 60 have the following relationship with the platen 44. That is, the ink absorber 60 related to marginless recording and the waste ink cartridge 68 related to the nozzle maintenance are required for a large occupied space inside the apparatus and become a barrier with respect to the miniaturization of the apparatus. On the other hand, the platen 44 which is provided at a position capable of being opposed to the recording head 42 and supports the paper P also requires for a large occupied space in a recording face direction of the paper P, in particular, in a width direction of the paper (an X-axis direction) and the size thereof is determined by the paper size. Then, in Example, both the ink absorber 60 and the waste ink cartridge 68 were arranged by utilizing the lower side region (the region of the −Z-axis direction side) of such the platen 44.

More specifically, in Example, the ink absorber 60 and the waste ink cartridge 68 were placed on the lower side of the platen 44 and were arranged in parallel with an X-axis direction which is a direction intersecting with a Y-axis direction which is a transporting direction of the paper P. In this manner, it is possible to attain the miniaturization of the apparatus while including the waste ink cartridge 68 and the ink absorber 60, by both the ink absorber 60 and the waste ink cartridge 68 utilizing the lower side region of the platen 44.

In addition, in Example, the ink absorber 60 and the waste ink cartridge 68 are arranged so that an occupied region of the ink absorber 60 and an occupied region of the waste ink cartridge 68 are overlapped in a Z-axis direction which is a height direction of the apparatus in the apparatus body 12. Therefore, since the occupied region of the ink absorber 60 and the occupied region of the waste ink cartridge 68 are overlapped in a vertical direction, it is possible to attain the miniaturization not only in a recording face direction of the paper P but also in a height direction of the apparatus.

In addition, the position of the bottom face of the ink absorber 60 and the position of the bottom face of the waste ink cartridge 68 are the same positions in a Z-axis direction, that is, are positioned on the same plane as shown in FIG. 8.

That is, since the bottom face of the ink absorber 60 and the bottom face of the waste ink cartridge 68 are on the same plane, the positions in a Z-axis direction which is a height direction of the apparatus of the ink absorber 60 and the waste ink cartridge 68 are aligned and thus it is possible to attain further miniaturization in a height direction of the apparatus (in a Z-axis direction) in the printer 10.

In addition, in Example, since the whole of the ink absorber 60 and the waste ink cartridge 68 are positioned on the lower side of the platen 44, that is, both the ink absorber 60 and the waste ink cartridge 68 are not protruded from the platen 44 in an X-axis direction and a Y-axis direction (refer to FIG. 6), it is possible to attain further miniaturization of the printer 10.

As to Configuration and Attachment and Detachment of Waste Ink Cartridge

Next, a configuration and an attaching and detaching method of the waste ink cartridge 68 will be described in more detail with reference to FIGS. 10 to 13. The waste ink cartridge 68 includes an IC substrate 72 and a waste ink passage hole 74 as shown in FIG. 10. The IC substrate 72 includes a memory device for memorizing information such as the storing amount of the waste ink stored in the waste ink cartridge 68 and holds information of the waste ink cartridge 68.

In addition, an IC substrate connecting portion 70*a* and a waste ink passage hole connecting portion 70*b* are provided on the cartridge mounting portion 70 as shown in FIG. 13. The IC substrate connecting portion 70*a* is electrically connected to the IC substrate 72 in a state in which the waste ink cartridge 68 is connected to the cartridge mounting portion 70. In addition, the waste ink passage hole connecting portion 70*b* is connected to the waste ink passage hole 74 and is in a communicating state with the cap unit 52 through the waste ink tube 66, the pump 62, and the waste ink tube 64.

Here, the IC substrate 72 is electrically connected to the control portion (not shown) provided in the apparatus body 12 in a state in which the waste ink cartridge 68 is connected to the cartridge mounting portion 70. Accordingly, information is transmitted from the IC substrate 72 to the control portion or from the control portion to the IC substrate 72 between the IC substrate 72 and the control portion.

The waste ink which is abandoned or is sucked in the cap unit 52 can be stored in the waste ink cartridge 68, however, the waste ink cartridge 68 is exchangeable and it becomes possible to continuously use the printer 10 by exchanging the waste ink cartridge 68 even if the waste ink cartridge 68 reaches a storage limit before the lifetime of the apparatus of the printer 10 is ended.

Here, the control portion (not shown) in the apparatus body 12 is electrically connected to the IC substrate 72 of the waste ink cartridge 68 and information of the storing residual amount of the waste ink in the waste ink cartridge 68 is transmitted from the IC substrate 72. Moreover, when the storing capacity of the waste ink of the waste ink cartridge 68 reaches its limit and the exchange of the waste ink cartridge 68 is required, the control portion displays exchange information of the waste ink cartridge 68 on the display panel of the operation portion 18.

Therefore, a user can know that the waste ink cartridge 68 reaches the storing limit from the display of the display panel of the operation portion 18 and can exchange the waste ink cartridge 68 based on exchange information of the waste ink cartridge 68 displayed on the display panel. Therefore, it is possible to exchange the waste ink cartridge 68 at appropriate timing.

An exchanging method of the waste ink cartridge 68 in the apparatus body 12 will be described. A cover 76 which is attachable and detachable with respect to the lower housing 11 is provided on the outer side bottom face 11*c* of the lower housing 11 as shown in FIG. 11. The cover 76 configures a part of the outer side bottom face 11*c* with the lower housing 11 in a state of being attached to the lower housing 11.

The cover 76 is removed from the outer side bottom face 11*c* of the lower housing 11 as shown in FIG. 12, the waste ink cartridge 68 in a state of being connected to the cartridge mounting portion 70 is exposed. In this state, the waste ink cartridge 68 is slid in a +X-axis direction. Accordingly, the connection state between the IC substrate 72 and the IC substrate connecting portion 70*a* and the connection state between the waste ink passage hole 74 and the waste ink passage hole connecting portion 70*b*, that is, the connection state between the waste ink cartridge 68 and the cartridge mounting portion 70 are eliminated. Accordingly, it is possible to remove the waste ink cartridge 68 from the apparatus body 12.

Moreover, when the used waste ink cartridge 68 is removed from the apparatus body 12 as shown in FIG. 13, a space for storing the waste ink cartridge in the lower housing 11, the IC substrate connecting portion 70*a*, and the waste ink passage hole connecting portion 70*b* are exposed. In this state, when the new waste ink cartridge 68 is stored in the space and the slide operation is carried out in an X-axis direction, the new waste ink cartridge 68 and the cartridge mounting portion 70 are connected. Moreover, when the cover 76 is attached to the outer side bottom face 11*c* of the lower housing 11, the exchange of the waste ink cartridge 68 is completed.

As described above, since the waste ink cartridge 68 is attachably and detachably provided, when the waste ink cartridge 68 reaches an upper limit of the storing capacity of the waste ink, it is possible to attain the prolongation of the lifetime of the entire printer 10 by exchanging the waste ink cartridge 68.

In addition, in Example, since the waste ink cartridge 68 is premised to be exchanged, there is no need to enlarge the waste ink cartridge 68 and attain an increase in storing amount of the waste ink and it is possible to minimize the waste ink cartridge 68. As a result, it is possible to store the waste ink cartridge 68 in region of the lower side of the platen 44 and attain further minimization of the printer 10.

Meanwhile, the whole of the ink absorber 60 and the waste ink cartridge 68 in Example described above are configured so as to be positioned on the lower side of the platen 44, however, at least a part of the ink absorber 60 and at least a part of the waste ink cartridge 68 may be configured so as to be positioned on the lower side of the platen 44, instead of this configuration. That is, a part of the ink absorber 60 or the waste ink cartridge 68 may be configured so as to protrude to the outside of the platen 44 in FIG. 6.

In addition, in Example described above, the home position of the carriage 40 is configured so as to be provided on the end part of the −X-axis direction side of the apparatus body 12, however, the home position of the carriage 40 may be set to a position close to the end part of the +X-axis direction side of the apparatus body 12, instead of this configuration.

In addition, in Example described above, the pump 62 is configured so as to be provided on the end part of the −X-axis direction side in the apparatus body 12, however, the pump 62 may be configured so as to be provided on the end part of the +X-axis direction side of the apparatus body 12, instead of this configuration.

In addition, in Example described above, the ink absorber 58 is configured so as to be provided on the concave portion 56 of the platen 44 as a liquid receiving portion, however, only the concave portion 56 may be configured so as to temporarily reserve the ink which is abandoned from the recording head 42 without arranging the ink absorber 58 on the concave portion 56, instead of this configuration.

Arrangements of Cap Unit, Transporting Driving Roller, Power Transmitting Unit, and Pump Next, arrangements of the cap unit 52, the transporting driving roller 38*a*, a power transmitting unit 89, and the pump 62 will be described with reference to FIG. 16 to FIG. 19.

The cap unit 52 and the pump 62 which were already described are provided in an end part region of the home position side (a −X direction) in a moving direction (an X-axis direction) of the carriage 40.

Meanwhile, the pump 62 is drawn by omitting a casing member (a housing configuring an appearance of the pump) in FIGS. 17 to 19 and an illustration of the waste ink tube 64 of the periphery of the pump 62 is omitted in FIGS. 18 and 19. In addition, signs 62*a* and 62*a* in the pump 62 indicate rollers for squeezing the waste ink tube 64. The pump 62 exhibits a function as a pump by squeezing the waste ink tube 64 by these rollers 62*a* and 62*a*.

Meanwhile, the pump 62 is selectively driven by a motor for feeding 29. The motor for feeding 29 is a driving source of the feeding roller 34, is provided with a power switching unit 33 on a power transmission route between the motor for feeding 29 and the feeding roller 34, and is configured so that the power of the motor for feeding 29 by the power switching unit 33 is selectively transmitted to any one of the feeding roller 34 and the pump 62.

Next, a transmission gear 85 is provided on a shaft end of the transporting driving roller 38*a* and a gear 86 meshes with the transmission gear 85 in FIGS. 17 to 19. A cam member 87 which is rotated with the gear 86 is provided behind the gear 86 and the cam member 87 is engaged with the cap unit 52. The transmission gear 85, the gear 86, and the cam member 87 configure a power transmitting unit 89 for transmitting power from the transporting driving roller 38*a* to the cap unit 52.

That is, the cap unit 52 is displaceably (capable of being advanced and retracted with respect to the recording head 42) provided in a vertical direction so as to be able to be placed at the sealing position in which the cap 52*a* seals the recording head 42 to prevent ink from drying and at the separation position in which the cap 52*a* is separated from the recording head 42, as described above. The cap unit 52 is biased in an upward direction (a direction toward the sealing position) by a biasing unit (not shown) and the cam member 87 pushed down the cap unit 52 in a downward direction (a direction toward the separation position) against a biasing force of the biasing unit accompanied with the rotation or allows the displacement in an upward direction of the cap unit 52. That is, the transporting driving roller 38*a* becomes a power source and the cap unit 52 is configured so that the cap unit 52 is vertically moved accompanied with the rotation of the transporting driving roller 38*a*.

In the configurations described above, as characteristics of the embodiment, at least a part of each of the cap unit 52, the power transmitting unit 89, and the pump 62 has the same height in a height direction of the apparatus (a Z-axis direction) and the cap unit 52, the power transmitting unit 89, and the pump 62 are arranged along a direction (a Y-axis direction) intersecting with a rotational axis line direction (an X-axis direction) of the transporting driving roller 38*a*, as it is clear from FIG. 19.

Therefore, accordingly, it is possible to arrange the cap unit 52, the power transmitting unit 89, and the pump 62 so as to suppress each dimension in a height direction and it is possible to contribute to the miniaturization of the apparatus.

In addition, in the embodiment, at least a part of each of the transporting driving roller 38*a* in addition to the cap unit 52, the power transmitting unit 89, and the pump 62 has the same height in a height direction of the apparatus (a Z-axis direction) and the transporting driving roller 38*a*, the cap unit 52, the power transmitting unit 89, and the pump 62 are arranged along a direction (a Y-axis direction) intersecting with a rotational axis line direction (a X-axis direction) of the transporting driving roller 38*a*.

Therefore, accordingly, it is possible to arrange the cap unit 52, the transporting driving roller 38*a*, the power transmitting unit 89, and the pump 62 so as to suppress each dimension in a height direction and it is possible to contribute to the miniaturization of the apparatus.

Meanwhile, in the embodiment, when focusing on the transporting driving roller 38*a*, the transporting driving roller 38*a* is positioned in the occupied region of the cap unit 52, the power transmitting unit 89, and the pump 62 in a height direction of the apparatus (a Z-axis direction). In other words, the occupied region in a height direction (a Z-axis direction) of the transporting driving roller 38*a* and the occupied region in a height direction (a Z-axis direction) of a part of the cap unit 52 have the same height. In addition, the occupied region in a height direction (a Z-axis direction) of the transporting driving roller 38*a* and the occupied region in a height direction (a Z-axis direction) of a part of the power transmitting unit 89 have the same height. In addition, the occupied region in a height direction (a Z-axis direction) of the transporting driving roller 38*a* and the occupied region in a height direction (a Z-axis direction) of a part of the pump 62 have the same height.

In addition, in the embodiment, since at least more than one of the cap unit 52, the transporting driving roller 38*a*, the power transmitting unit 89, and the pump 62 (in the embodiment, the cap unit 52, the power transmitting unit 89, and the pump 62) are arranged in a Y-axis direction along an inner side bottom face 11*a* of the lower housing 11, it is possible to arrange the cap unit 52, the transporting driving roller 38*a*, the power transmitting unit 89, and the pump 62 so as to further suppress each dimension in a height direction and it is possible to further contribute to the miniaturization of the apparatus.

In addition, in the embodiment, since at least more than one of the cap unit 52, the transporting driving roller 38*a*, the power transmitting unit 89, and the pump 62 (in the embodiment, the cap unit 52, the power transmitting unit 89, and the pump 62) are arranged along a side wall 11*b* of the lower housing 11, it is possible to suppress the dimension of the apparatus in a rotational axis line direction (a X-axis direction) of the transporting driving roller 38*a*.

Meanwhile, in the embodiment, the occupied region in a width direction of the apparatus (an X-axis direction) of the power transmitting unit 89 is used by all of the transporting driving roller 38*a*, the cap unit 52, and the pump 62, as it is clear from FIG. 18. More specifically, for example, the transmission gear 85 configuring the power transmitting unit 89 is positioned in the occupied region of the transporting driving roller 38*a*, the cap unit 52, and the pump 62 in a width direction of the apparatus (an X-axis direction).

In addition, in the embodiment, the side frames 79 and 80 which are frames extended in a direction intersecting with an X-axis direction which is an axis line direction of the transporting driving roller 38*a*, that is, in a Y-axis are provided on both end parts of the moving region of the carriage 40 and the transporting driving roller 38*a* is supported by the side frames 79 and 80 on both end parts. Therefore, there is no need to further interpose an intermediate frame for supporting the transporting driving roller 38*a* in the moving region of the carriage 40 and it is possible to avoid an increase in dimension of the apparatus in an X-axis direction.

Furthermore, in the embodiment, the platen 44 which is a medium support member is extended between the side frames 79 and 80 provided on both end parts of the moving region of the recording head 42 and includes an opening 44*a* on the side on which the cap unit 52 is provided (FIG. 14 and FIG. 15), and the cap unit 52 is arranged on the inner side of the opening 44*a*. Therefore, there is no need to further interpose the intermediate frame for providing the cap unit 52 in the moving region of the carriage 40 and it is possible to avoid an increase in dimension of the apparatus in an X-axis direction.

Furthermore, in the embodiment, the transporting driving roller 38*a* is positioned on the lower side of the guide frame 82 which is a support member for supporting the carriage 40 and is positioned in the region of the guide frame 82 in a transporting direction of the paper (a y direction), as shown in FIG. 3. More specifically, the entire region of the occupied range in a transporting direction of the paper (a y direction) of the transporting driving roller 38*a* is on the inner side of the occupied range in a transporting direction of the paper (a y direction) of the guide frame 82.

Accordingly, each dimension of the transporting driving roller 38*a* and the guide frame 82 is not independently added as to the dimension of the apparatus in a transporting direction of the paper (a y direction) and thus, it is possible to suppress the dimension of the apparatus in a transporting direction of the paper (a y direction).

In the embodiment described above, while the invention is applied to the ink jet printer as an example of the recording apparatus, it is also possible to generally apply to other liquid ejecting apparatuses.

Here, as a liquid ejecting apparatus, the liquid ejecting apparatus is not limited to a recording apparatus such as a printer, a copying machine, or a facsimile in which an ink jet type recording head is used and recording is performed on a medium to be recorded by discharging ink from the liquid ejecting head, and includes an apparatus in which liquid corresponding to its application instead of ink is ejected to a medium to be ejected equivalent to the medium to be recorded from an liquid ejecting head equivalent to the ink jet type recording head to adhere the liquid to the medium to be ejected.

As a liquid ejecting head, a color material ejecting head used in manufacturing of a color filter of a liquid crystal display or the like, an electrode material (a conductive paste) ejecting head used in forming an electrode of an organic EL display, a surface emitting display (FED), or the like, a living body organic matter ejecting head used in manufacturing a biochip, a sample ejecting head as a precision pipette, and the like are included in addition to the recording head.

Meanwhile, the invention is not limited to the Examples described above, various modifications can be carried out within the scope of the invention described in claims, and it goes without saying that these are also included within the scope of the invention.

The entire discovery of Japanese Patent Application No.: 2014-130408, filed Jun. 25, 2014 is expressly incorporated by reference herein.

What is claimed is:

1. A recording apparatus comprising:

a recording head configured and arranged to perform recording by ejecting liquid with respect to a medium;

a maintenance portion configured and arranged to perform maintenance of the recording head displaceably provided in a direction of being advanced and retracted with respect to the recording head;

a pump which is connected to the maintenance portion by a tube;

a transporting roller configured and arranged to transport a medium; and a power transmitting unit configured and arranged to transmit power from the transporting roller to the maintenance portion such that the maintenance portion is advanced and retracted by the power, wherein at least a part of each of the maintenance portion, the transporting roller, the power transmitting unit, and the pump has the same height in a height direction of the apparatus and the maintenance portion, the transporting roller, the power transmitting unit, and the pump are arranged along a horizontal direction intersecting with a rotational axis line direction of the transporting roller, the maintenance portion and the pump are arranged such that the transporting roller is interposed therebetween in the horizontal direction intersecting with the rotational axis line direction of the transporting roller, and the power transmitting unit includes a first gear provided on a shaft of the transporting roller, a second gear meshing with the first gear, and a cam member rotated with the second gear, the second gear and the cam member being disposed such that the shaft of the transporting roller is interposed between the second gear and the maintenance portion, the cam member including an arm which extends below the shaft of the transporting roller from a side of the shaft of the transporting roller where the second gear is located, and the cam member being engaged with the maintenance portion via the arm so as to transmit power from the second gear to the maintenance portion via the cam member.

2. The recording apparatus according to claim 1, further comprising:

a housing storing the maintenance portion, the transporting roller, the power transmitting unit, and the pump, wherein at least more than one of the maintenance portion, the transporting roller, the power transmitting unit, and the pump are arranged along a bottom face of the housing.

3. The recording apparatus according to claim 2, wherein at least more than one of the maintenance portion, the transporting roller, the power transmitting unit, and the pump are arranged along a side wall of the housing.

4. The recording apparatus according to claim 1, further comprising:

a carriage which includes the recording head and is movable in a predetermined direction; and a supporting member which is extended in a moving direction of the carriage and supports the carriage, wherein the transporting roller is positioned below the supporting member and is positioned in a region of the supporting member in a transporting direction of the medium.

5. The recording apparatus according to claim 1, wherein the power transmitting unit is directly engaged with the maintenance portion.

* * * * *